US007399051B2

(12) United States Patent
Miyasaka

(10) Patent No.: US 7,399,051 B2
(45) Date of Patent: Jul. 15, 2008

(54) EJECTION DEVICE, MATERIAL COATING METHOD, METHOD OF MANUFACTURING COLOR FILTER SUBSTRATE, METHOD OF MANUFACTURING ELECTROLUMINESCENCE DISPLAY DEVICE, AND METHOD OF MANUFACTURING PLASMA DISPLAY DEVICE

(75) Inventor: Yoichi Miyasaka, Suwa (JP)

(73) Assignee: Seiko Epson Corporation (JP)

( * ) Notice: Subject to any disclaimer, the term of this patent is extended or adjusted under 35 U.S.C. 154(b) by 351 days.

(21) Appl. No.: 11/062,346

(22) Filed: Feb. 18, 2005

(65) Prior Publication Data

US 2005/0185006 A1 Aug. 25, 2005

(30) Foreign Application Priority Data

Feb. 19, 2004 (JP) ..... 2004-043021

(51) Int. Cl.

| | |
|---|---|
| ***B41J 2/015*** | (2006.01) |
| ***B41J 2/145*** | (2006.01) |
| ***B41J 2/15*** | (2006.01) |
| ***B41J 2/155*** | (2006.01) |

(52) U.S. Cl. ..... 347/20; 347/40; 347/41; 347/42

(58) Field of Classification Search ..... 347/9, 347/16, 20, 40–42; 427/427.1, 427.3
See application file for complete search history.

(56) References Cited

U.S. PATENT DOCUMENTS

| | | | | |
|---|---|---|---|---|
| 6,302,520 | B1 * | 10/2001 | Akiyama et al. | 347/43 |
| 2003/0151637 | A1 * | 8/2003 | Nakamura et al. | 347/20 |
| 2003/0184613 | A1 * | 10/2003 | Nakamura et al. | 347/40 |
| 2004/0183851 | A1 * | 9/2004 | Nakamura | 347/20 |
| 2004/0257396 | A1 * | 12/2004 | Nishida et al. | 347/23 |
| 2005/0046656 | A1 * | 3/2005 | Miyasaka | 347/19 |
| 2005/0185007 | A1 * | 8/2005 | Miyasaka | 347/9 |

FOREIGN PATENT DOCUMENTS

| | | | |
|---|---|---|---|
| JP | 2002-221616 | | 8/2002 |
| JP | 2002221616 A | * | 8/2002 |
| JP | 2002-283621 | | 10/2002 |

* cited by examiner

*Primary Examiner*—Hai C Pham
*Assistant Examiner*—Kainoa B Wright
(74) *Attorney, Agent, or Firm*—Harness, Dickey & Pierce, P.L.C.

(57) ABSTRACT

A method of coating with a material includes the steps of moving at least one of a stage and a head relative to the other in a Y axis direction perpendicular to an X axis direction in a first pass period while positioning each ejection nozzle forming a first nozzle group in an ejectable range and positioning each nozzle forming a second nozzle group out of the ejectable range; and moving at least one of the stage and the head relative to the other in the Y axis direction perpendicular to the X axis direction in a second pass period while positioning each of the ejection nozzles forming the second nozzle group in the ejectable range.

5 Claims, 23 Drawing Sheets

EJECTION DEVICE, MATERIAL COATING METHOD, METHOD OF MANUFACTURING COLOR FILTER SUBSTRATE, METHOD OF MANUFACTURING ELECTROLUMINESCENCE DISPLAY DEVICE, AND METHOD OF MANUFACTURING PLASMA DISPLAY DEVICE

RELATED APPLICATIONS

This application claims priority to Japanese Patent Application No. 2004-043021 filed Feb. 19, 2004 which is hereby expressly incorporated by reference herein in its entirety.

BACKGROUND

1. Technical Field

The present invention relates to an ejection device and a material coating method, and in particular, it relates to an ejection device and a material coating method suitable for manufacturing a color filter substrate, manufacturing an electroluminescence display device, and manufacturing a plasma display device.

2. Related Art

An inkjet device used for manufacturing a color filter or for manufacturing an electroluminescence display device or the like is known (e.g., Japanese Unexamined Patent Publication No. 2002-221616).

When ejecting a color filter material to an area defined as a pixel in, for example, a color filter, nozzles used for ejecting the material and nozzles not used for ejecting the material are fixedly determined. The life of the head is problematically determined by the life of the nozzles frequently (nearly always) ejecting the material.

The present invention addresses the above problem, and one advantage thereof is to provide an ejection device and a material coating method capable of reducing the deterioration of a head in an ejection process.

SUMMARY

An ejection device according to the present invention is an ejection device for coating a target section of a base body with a liquid material, comprising: a stage for mounting the base body; a head having a plurality of ejection nozzles, each of the plurality of ejection nozzles belonging to either one of a first nozzle group and a second nozzle group adjacent to each other in an X axis direction; and a scan section for moving at least one of the stage and the head relative to the other in a Y axis direction perpendicular to the X axis direction in first and second scan periods. Each of the ejection nozzles forming the first nozzle group is positioned in an ejectable range of the target section along the X axis direction during the first scan period, and each of the ejection nozzles forming the second nozzle group is positioned out of the ejectable range during the first scan period. Further, the scan section moves at least one of the stage and the head relative to the other in the X axis direction in a period between the first scan period and the second scan period so as to position each of the ejection nozzles forming the second nozzle group in the ejectable range. Still further, the head ejects the liquid material to the target section from the ejection nozzles forming the first nozzle group in the first scan period. The head further ejects the liquid material to the target section from the ejection nozzles forming the second nozzle group in the second scan period.

One advantage obtained from the above configuration is to extend the life of the head. This is because it is possible to make the ejection nozzles not corresponding to the target section share the burden of ejection.

In a material coating method of the present invention, an ejection device equipped with a stage for mounting a base body and a head having a plurality of ejection nozzles each belonging to either of first and second nozzle groups adjacent to each other in an X axis direction is used to coat a target section of the base body with a liquid material. The above method includes the steps of: (A) moving at least one of a stage for mounting a base body and a head having a plurality of ejection nozzles, each belonging to either one of a first and a second nozzle group adjacent to each other in an X axis direction relative to the other in a Y axis direction perpendicular to the X axis direction in a first scan period while positioning each of the ejection nozzles forming the first nozzle group in an ejectable range of a target section of the base body along the X axis direction and each of the ejection nozzles forming the second nozzle group out of the ejectable range; (B) moving at least one of the stage and the head relative to the other in the Y axis direction perpendicular to the X axis direction in a second scan period while positioning each of the ejection nozzles forming the second nozzle group in the ejectable range; (C) ejecting the liquid material from each of the nozzles forming the first nozzle group to the target section in the first scan period; and (D) ejecting the liquid material from each of the nozzles forming the second nozzle group to the target section in the second scan period.

One advantage obtained from the above configuration is to extend the life of the head. This is because it is possible to make the ejection nozzles not corresponding to the target section share the burden of ejection.

The present invention can be realized in various forms such as, for example, a method of manufacturing a color filter substrate, a method of manufacturing an electroluminescence display device, or a method of manufacturing a plasma display device.

DETAILED DESCRIPTION

Embodiment 1

The present embodiment will be explained in the order described below.

A. Overall configuration of an ejection device 100R

B. Head

C. Control section

D. Color filter substrate

E. Coating process

A. Overall Configuration of an Ejection Device 100R

Figure 1:
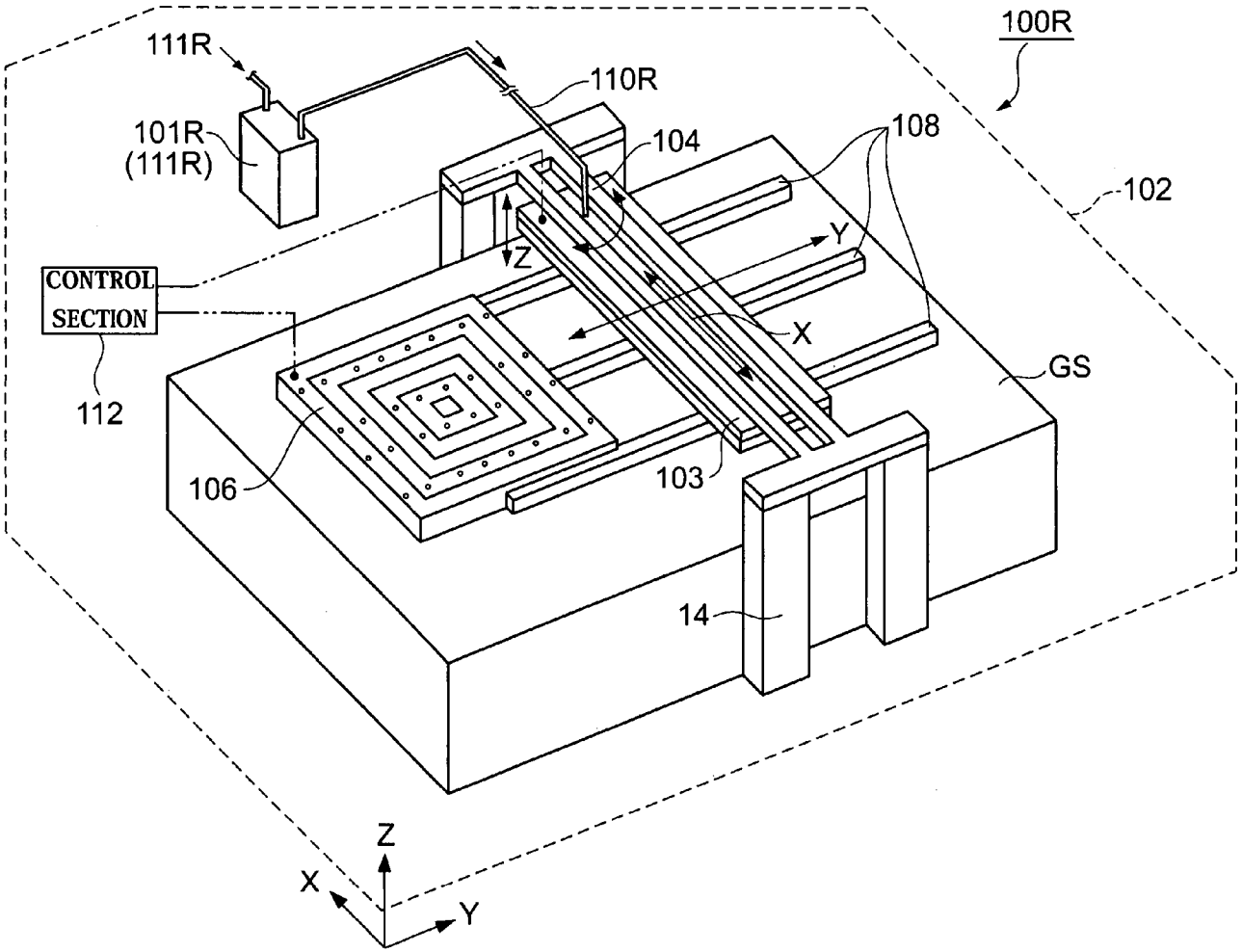
FIG. 1 is a schematic view showing an ejection device of an embodiment 1.

The ejection device 100R shown in FIG. 1 is a kind of a material coating device and equipped with a tank 101R for containing liquid color filter material 111R, a tube 110R, and an ejection scanning section 102 to which the liquid color filter material 111R is supplied from the tank 101R via the tube 110R. The ejection scanning section 102 is equipped with a ground stage GS, an ejection head section 103, a first position controller 104, a stage 106, a second position controller 108, and a control section 112.

The ejection head section 103 holds a plurality of heads 114 (See FIG. 2) for electing the liquid color filter material 111R towards the stage 106. Each of these heads 114 ejects a droplet of the liquid color filter material 111R in response to a signal from the control section 112. The tank 101R and the plurality of heads 114 of the ejection head section 103 are connected via the tube 110R to supply each of the heads 114 with the liquid color filter material 111R from the tank 101R.

Note that the liquid color filter material 111R corresponds to "liquid material" of the present invention.

"Liquid material" denotes a material having a viscosity suitable to be ejected as a droplet from the nozzles (described below) of the heads 114. In this case, it does not matter whether the material is water-based or oil-based. It is sufficient to have a fluidic nature (viscosity) with which it can be ejected from the nozzles, and does not matter if it includes solid substances as long as it remains a fluid as a whole.

A first position controller 104 moves the ejection head section 103 along the X axis direction and the Z axis direction perpendicular to the X axis direction. Further, the first position controller 104 also has a function of rotating the ejection head section 103 around a shaft parallel to the Z axis. In the present embodiment, the Z axis direction is a direction parallel to the vertical direction (namely, the direction of gravitational acceleration).

Specifically, the first position controller 104 is equipped with a pair of linear motors extending in the X axis direction, a pair of X axis guide rails extending in the X axis direction, an X axis air slider, a pivot section, and a supporting structure 14. The supporting structure 14 fixes the pair of linear motors, the pair of X axis guide rails, a pair of X axis air sliders, and the pivot section at a position with a predetermined distance from the stage 106. Meanwhile, the X axis air slider is movably supported by the pair of X axis guide rails. The X axis air slider moves in the X axis direction along the pair of X axis guide rails while driven by the pair of linear motors. Since the ejection head section 103 is linked with the X axis air slider via the pivot section, the ejection head section 103 moves in the X axis direction with the X axis air slider. Note that the ejection head 103 is supported by the X axis air slider so that the nozzles (described below) of the ejection head section 103 face the stage 106. In addition, the pivot section includes a servo motor to have a function of rotating the ejection head section 103 around a shaft parallel to the Z axis.

The second position controller 108 moves the stage 106 in accordance with a signal from the control section 112 along the Y axis perpendicular to both the X axis direction and the Z axis direction. Further, the second position controller 108 also has a function of rotating the stage 106 around a shaft parallel to the Z axis. Specifically, the second position controller 108 is equipped with a pair of linear motors extending in the Y axis direction, a pair of Y axis guide rails extending in the Y axis direction, a Y axis air slider, a support base, and a θ table. The pair of linear motors and the pair of Y axis guide rails are positioned on the ground stage GS. Meanwhile, the Y axis air slider is movably supported by the pair of Y axis guide rails. The Y axis air slider moves in the Y axis direction along the pair of Y axis guide rails while driven by the pair of linear motors. Since the Y axis air slider is linked with the rear surface of the stage 106 via the support base and the θ table, the stage 106 moves with the Y axis air slider in the Y axis direction. In addition, the θ table includes a motor to have a function of rotating the stage 106 around a shaft parallel to the Z axis.

Note that, in the present specification, the first position controller 104 and the second position controller 108 are also denoted as the "scanning section."

The X axis, the Y axis, and the Z axis in the present embodiment correspond to directions along which one of the ejection head section 103 and the stage 106 moves relative to the other. Further, the ideal origin of the XYZ coordinate system defining the X axis direction, the Y axis direction, and the Z axis direction is fixed to a reference portion of the ejection device 100R. In the present specification, the X coordinate, the Y coordinate, and the Z coordinate are coordinates in such XYZ coordinate system. Note that the ideal origin described above can also be fixed to the stage 106 or the ejection head section 103 other than the reference portion.

As described above, the ejection head section 103 is moved by the first position controller 104 in the X direction. Meanwhile, the stage 106 is moved by the second position controller 108 in the Y direction. Namely, the relative positions of the heads 114 to the stage 106 are changed by the first position controller 104 and the second position controller 108. Further specifically, by these actions, the ejection head section 103, the heads 114, or the nozzles 118 (See FIG. 2) move relative to a target section (on which the ejected droplet lands) aligned on the stage 106 in the X direction and the Y direction keeping a predetermined distance in the Z direction, namely scan relative thereto. In this case, the ejection head section 103 can move relative to the stationary target section in the Y direction. While the ejection head section 103 moves between predetermined two points along the Y direction, material 111 can be ejected from the nozzles 118 (See FIG. 2) towards the stationary target section. "Relative movement" or "relative scanning" includes that at least one of an ejection side of the liquid color filter material 111R and a landing side (the target side) of the ejected material therefrom is moved against the other side thereof.

Further, relative movement of the ejection head section 103, the heads 114, or the nozzles 118 (See FIG. 2) means that the relative positions of these sections to the stage, the base body, or the target change. Therefore, in the present specification, even in case the ejection head section 103, the heads 114, or the nozzles 118 are stationary to the ejection device 100R while only the stage 106 moves, it is denoted that the ejection head section 103, the heads 114, or the nozzles 118 move relative to the stage 106, the base body, or the target. Further, the combination of relative scanning or the relative movement and the ejection of material may be denoted as a "coating scan."

The ejection head section 103 and the stage 106 have freedom of parallel shift and rotation in addition to those described above. However, in the present embodiment, descriptions regarding the freedom other than those described above are omitted for the sake of simplicity.

The control section 112 is arranged to receive, from an external information processing device, ejection data expressing relative positions to which the liquid color filter material 111R is ejected. A detailed configuration and function of the control section 112 are described later.

B. Head

Figure 2:
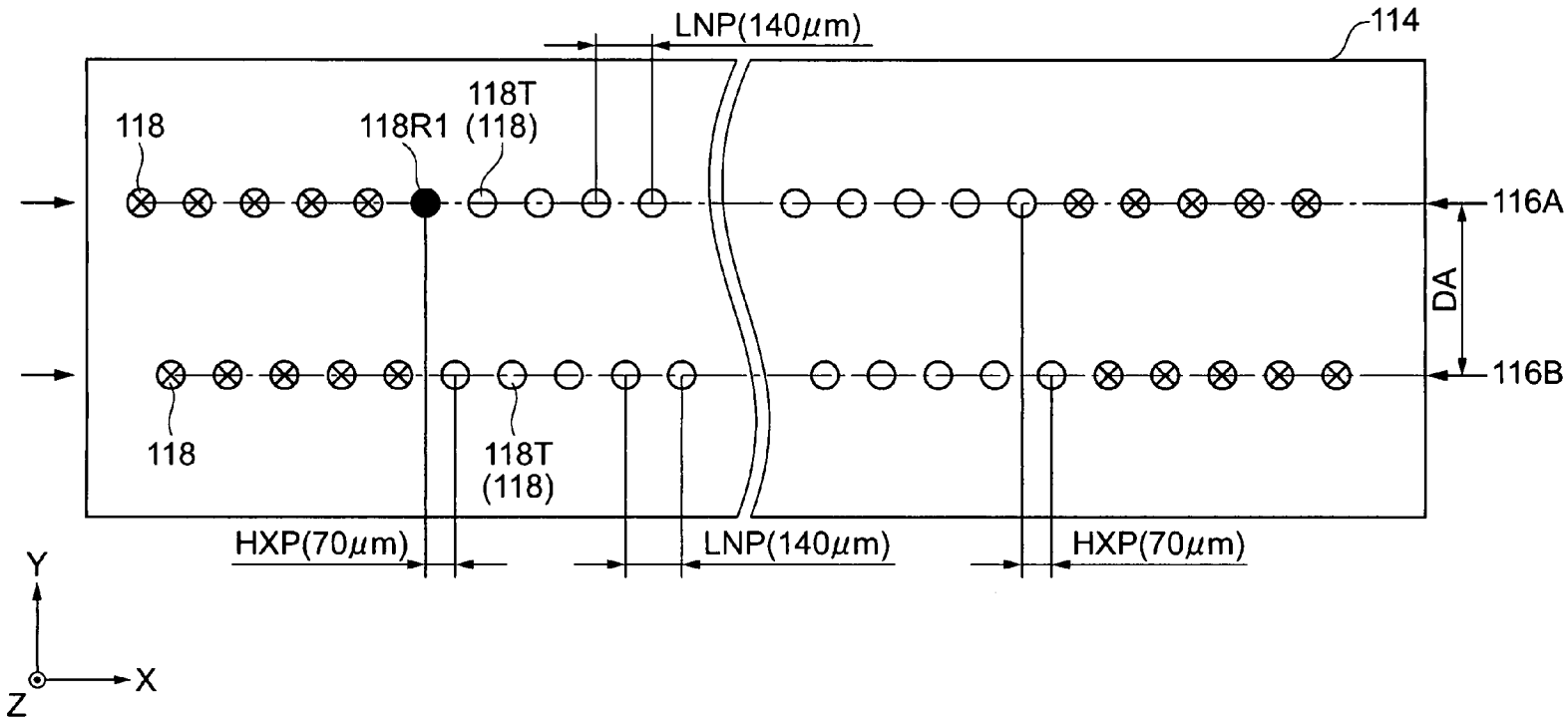
FIG. 2 is a schematic view showing an arrangement of nozzles in a head of embodiment 1.

The head 114 shown in FIG. 2 is one of a plurality of heads 114 included in the ejection head section 103. FIG. 2 is a view of the head 114 from a point of view of the stage 106 and showing the bottom of the head 114. The head 114 has a nozzle train 116 extending in the X axis direction. The nozzle train 116 is composed of a plurality of nozzles 118 aligned in the X axis direction with a substantially constant pitch. These nozzles 118 are arranged so that an X axis direction nozzle pitch HXP of the head 114 is about 70 μm. Note that "the X axis direction nozzle pitch HXP of the head 114" corresponds to a pitch of a plurality of nozzle images obtained by mapping all of the nozzles 118 of the head 114 on the X axis in a direction perpendicular to the X axis direction.

The number of nozzles 118 in the nozzle train 116 is preferably 180. Here, ten nozzles at each end of the nozzle train 116 are set to be "idle nozzles." No liquid color filter material 111R is ejected from these twenty "idle nozzles." Therefore, 160 nozzles 118 out of the 180 nozzles 118 of the head 114 function as nozzles 118 for ejecting the liquid color filter material 111R. In the present specification, these 160 nozzles 118 may be denoted as "ejection nozzles 118T."

Note that the number of nozzles 118 in each of the heads 114 is not limited to 180. For example, 360 nozzles can be provided in each of the heads 114.

Figure 3:
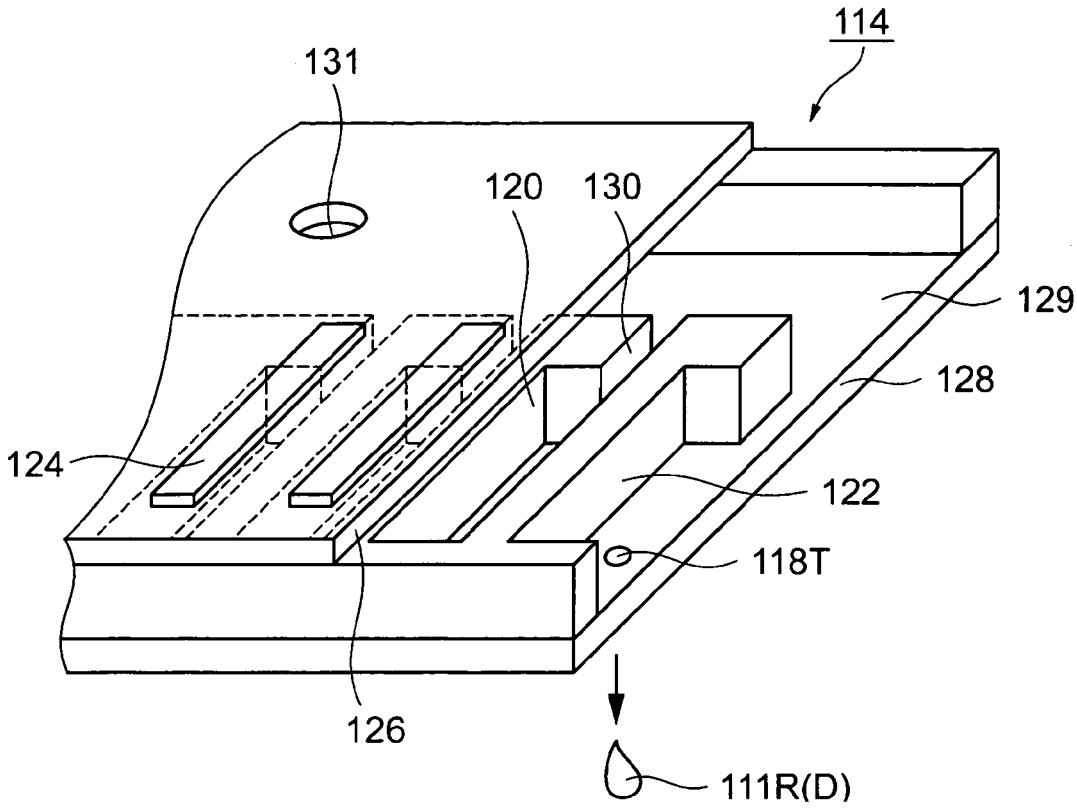
FIGS. 3(A) and 3(B) are schematic views showing an ejection section in the head of embodiment 1.
Figure 3:
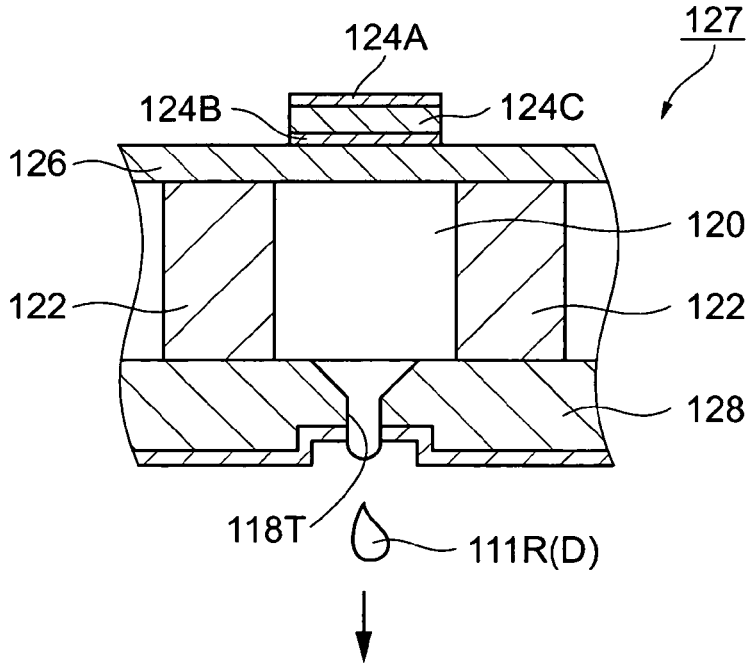

As shown in FIGS. 3(A) and 3(B), each of the heads 114 is an inkjet head. More specifically, each of the heads 114 is provided with a diaphragm 126 and a nozzle plate 128. Between the diaphragm 126 and the nozzle plate 128, there is positioned a fluid chamber 129 continuously filled with the liquid color filter material 111R supplied from two tanks 101R (See FIG. 1) via an opening 131.

Further, a plurality of partitions 122 are positioned between the diaphragm 126 and the nozzle plate 128. A space surrounded by the diaphragm 126, the nozzle plate 128, and a pair of partitions 122 is defined as a cavity 120. Since the cavity 120 is provided corresponding to each of the nozzles 118, the number of cavities 120 and the number of nozzles 118 are the same. The liquid color filter material 111R is supplied to the cavities from the fluid chamber 129 via supply ports 130 each positioned between a pair of partitions 122.

On the diaphragms 126, there are positioned vibrators 124 corresponding to each of the cavities 120. Each of the vibrators 124 includes a piezoelectric element 124C and a pair of electrodes 124A and 124B tightly holding the piezoelectric element 124C. By applying a drive voltage between the pair of electrodes 124A, 124B, the liquid color filter material 111R is ejected from the corresponding nozzle 118. Note that the shape of the nozzle 118 is arranged so that the liquid color filter material 111R is ejected from the nozzle 118 in the Z axis direction.

Here, "liquid material" in the present specification denotes a material having viscosity suitable to be ejected from the nozzle. In this case, it does not matter whether the material is water-based or oil-based. It is sufficient to have a fluidic nature (viscosity) with which it can be ejected from the nozzles, and does not matter if it includes solid substances as long as it remains a fluid as a whole.

The control section 112 (See FIG. 1) can be configured to provide signals to each of the plurality of vibrators 124 independently from each other. In other words, the volume of the fluid material ejected from the nozzles 118 can be controlled for each of the nozzles 118 in accordance with the signals from the control section 112. In such a case, the volume of the liquid material ejected from each of the nozzles 118 can be variably set, for example, in a range from 0 pl to 42 pl (picoliter). Further, as described below, the control section 112 can also determine which nozzles 118 execute the ejection operations during the coating scan and which nozzles 118 do not execute the ejection operations.

In the present specification, the portion including one of the nozzles 118, the cavity 120 corresponding to the nozzle 118, and the vibrator 124 corresponding to the cavity 120 may be denoted as "an ejection section 127." According to this description, one of the heads 114 comprises the same number of ejection sections 127 as the number of nozzles 118. Each ejection section 127 can comprise an electrothermal transducer element instead of the piezoelectric element. In other words, the ejection section 127 can comprise a configuration of ejecting the material using thermal expansion of the material by the electrothermal transducer element.

C. Control Section

Figure 4:
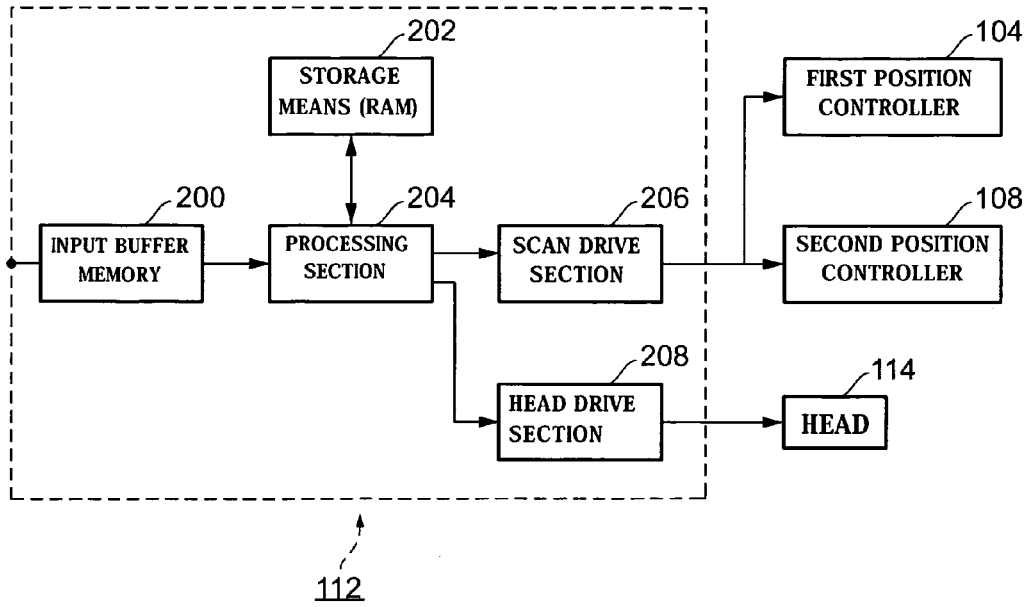
FIG. 4 is a functional block diagram of a control section in the ejection device of embodiment 1.

A configuration of the control section 112 is hereinafter described. As shown in FIG. 4, the control section 112 is equipped with an input buffer memory 200, a storage unit 202, a processing section 204, a scan drive section 206, and a head drive section 208. The buffer memory 202 and the processing section 204 are connected to communicate with each other. The processing section 204 and the storage unit 202 are also connected to communicate with each other. The processing section 204 and the scan drive section 206 are further connected to communicate with each other. The processing section 204 and the head drive section 208 are also connected to communicate with each other. Further, the scan drive section 206 is connected to the first position controller 104 and the second position controller 108 to communicate with each other. Likewise, the head drive section 208 is connected to each of the heads 114 to communicate with each other.

The input buffer memory 200 receives the ejection data used for ejecting the color filter material 111R from a host computer (not shown) positioned outside the ejection device 100R.

The input buffer memory 200 supplies the ejection data to the processing section 204, and then the processing section 204 stores the ejection data in the storage unit 202. In FIG. 4, the storage unit 202 is a RAM. Note that the ejection device 100R can include a computer functioning as the external host computer inside the control section 112.

The processing section 204 provides data expressing the relative position of the nozzles 118 to the target section to the scan drive section 206 based on the ejection data stored in the storage unit 202. The scan drive section 206 provides the drive signal corresponding to this data and the ejection period to the second position controller 108. As a result, the head 114 scans relative to the target section. Meanwhile, the processing section 204 provides the ejection signal necessary for ejection of the liquid color filter material 111R to each of the plurality of heads 114 based on the ejection data stored in the storage unit 202. Accordingly, droplets D (shown in FIGS. 3(A) and 3(B)) of the liquid color filter material 111R are ejected from the nozzles 118 of each of the plurality of heads 114.

The control section 112 can be a computer including a CPU, a ROM, a RAM, and a bus. In this case, the function of the control section 112 described above is realized by software programs executed by the computer. The control section 112 can also be realized by a dedicated circuit (hardware).

D. Color Filter Substrate

A base body 10A shown in FIGS. 5(A) and 5(B) is a substrate to form a color filter substrate 10 through a process performed by a manufacturing device 1 described in the following embodiment 2. The base body 10A includes a plurality of target sections 18R, 18G, and 18B arranged like a matrix.

Specifically, the base body 10A includes a support substrate 12 having light translucency, a black matrix 14 formed on the support substrate 12, a bank 16 formed on the black matrix 14. The black matrix 14 is made of a light blocking material. The black matrix 14 and the bank 16 on the black matrix 14 are positioned so as to define a matrix of a plurality of light translucent sections on the support substrate 12, namely a matrix of a plurality of pixel areas.

In each of the pixel areas, a hollow section defined by the support substrate 12, the black matrix 14, and the bank 16 corresponds to the target section 18R, the target section 18G, or the target section 18B. The target section 18R is an area where a filter layer 111FR transmitting only light beams in the red wavelength band is to be formed, the target section 18G is an area where a filter layer 111FG transmitting only light beams in the green wavelength band is to be formed, and the target section 18B is an area where a filter layer 111FB transmitting only light beams in the blue wavelength band is to be formed.

The base body 10A shown in FIG. 5(B) is positioned on a virtual plane parallel to both the X axis direction and the Y axis direction. A row direction and a column direction of the matrix formed of the plurality of target sections 18R, 18G, and 18B are parallel to the X axis direction and the Y axis direction, respectively. In the base body 10A, the target sections 18R, the target sections 18G, and the target sections 18B are aligned in the Y axis direction periodically in this order. Meanwhile, the target sections 18R are aligned in a line in the X axis direction with a predetermined interval, the target sections 18G are aligned in a line in the X axis direction with a predetermined interval, and the target sections 18B are also aligned in a line in the X axis direction with a predetermined interval. Note that the X axis direction and the Y axis direction are perpendicular to each other.

An interval LRY of the target sections 18R along the Y axis direction, namely the pitch thereof is about 560 μm. The interval is equal to the interval LGY of the target sections 18G along the Y axis direction, and also to the interval LBY of the target sections 18B along the Y axis direction. Further, the planar image of the target section 18R is a polygon defined by longer sides and shorter sides. Specifically, the length of the target section 18R in the Y axis direction is about 100 μm, and the length thereof in the X axis is about 300 μm. The target sections 18G and the target sections 18B preferably have the same shapes and sizes as the target sections 18R. The intervals of the target sections and the sizes of the target sections correspond to the intervals and the sizes of the pixels of the same color in a high resolution digital television of about 40 inches.

E. Coating Process

A process of coating the liquid color filter material 111R on the target sections 18R of the base body 10A using the ejection device 100R will now be explained.

First Scan Period

Figure 6:
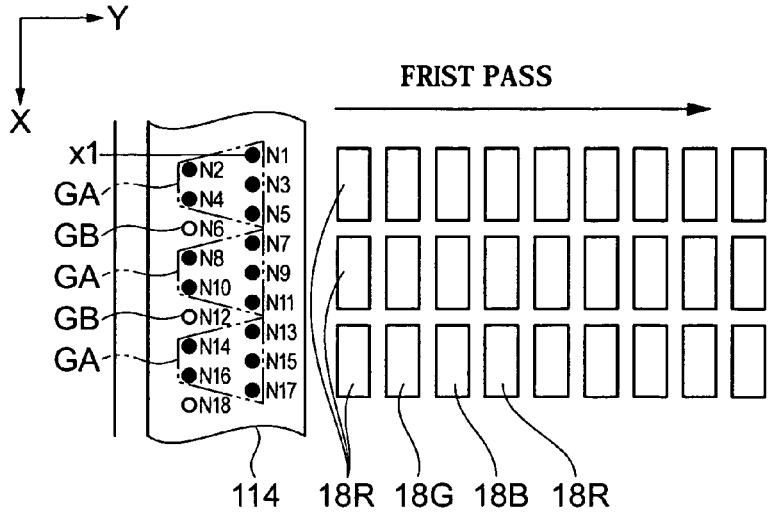
FIG. 6 is a schematic view showing a coating process of embodiment 1, in particular, a schematic view showing a first scan period to the base body.

As shown in FIG. 6, the base body 10A having the target sections 18R is disposed on a stage 106. Specifically, the base body 10A is disposed on the stage 106 so that the row direction and the column direction of the matrix formed by the plurality of target sections 18R becomes parallel to the X axis direction and the Y axis direction, respectively. In the present embodiment, in this case, the base body 10A is further aligned on the stage 106 so that the longer side direction of each of the target sections 18R becomes parallel to the X axis direction and the shorter side direction thereof becomes parallel to the Y axis direction.

Here, in FIG. 6, there are illustrated 18 ejection nozzles 118T. For the sake of convenience in explanation, these 18 ejection nozzles are denoted as nozzles N1, N2, N3, . . . , N18 sequentially from the one with the smallest X coordinate (sequentially from the top in FIG. 6). Note that the ejection nozzles with even numbers following the letter "N" belong to a first nozzle train 116A (shown in FIG. 2), and the ejection nozzles with odd numbers following the letter "N" belong to a second nozzle train 116B (shown in FIG. 2).

Further, as shown in FIG. 6, the nozzles N1 through N5 form a first nozzle group GA. The nozzles N7 through N11 form another first nozzle group GA. The nozzles N13 through N17 form still another first nozzle group GA. In contrast, each of the nozzles N6, N12, and N18 forms a respective one of second nozzle groups GB. In the present specification, even if the number of nozzles forming the first nozzle groups GA or the second nozzle groups GB is one, the description of "nozzle group" is used. As shown in FIG. 6, the first nozzle groups GA and the second nozzle groups GB are adjacent to each other in the X axis direction.

As shown in FIG. 6, a relative x coordinate of the head 114 to the stage 106 is maintained to be x1. Here, "the relative x coordinate of the head 114 to the stage 106" means an x coordinate in an internal coordinate system fixed to the stage 106. The directions of the x axis, y axis, and z axis of the internal coordinate system respectively correspond to the X axis direction, Y axis direction, and Z axis direction defined above. Further, "relative x coordinate of the head 114" means the relative x coordinate of a predetermined reference point of the head 114. For example, "relative x coordinate of the head 114" can be expressed with the relative x coordinate of a first reference nozzle 118R1 of the head 114.

When the relative x coordinate of the head 114 is x1, all the ejection nozzles 118T belonging to the first nozzle groups GA are positioned inside the ejectable range in the X axis direction of the target section 18R. In contrast, all the ejection nozzles 118T belonging to the second nozzle groups GB are positioned outside the ejectable range in the X axis direction of the target section 18R.

Figure 8:
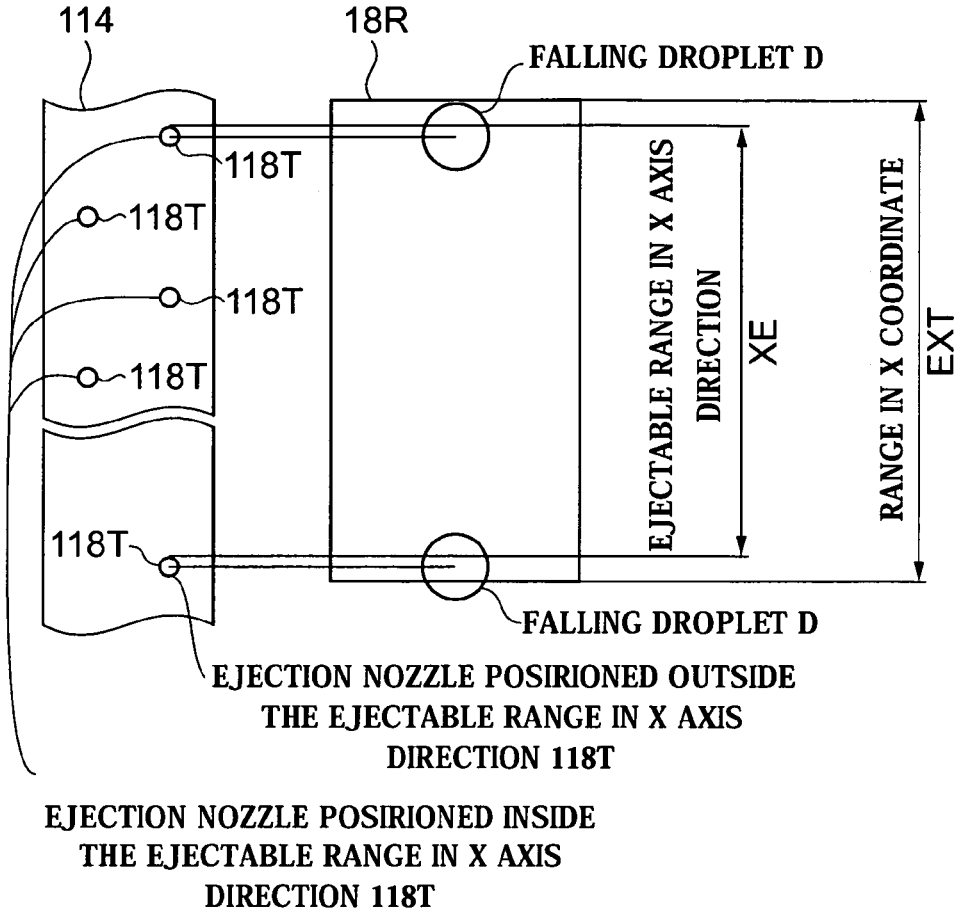
FIG. 8 is a view for explaining the "ejectable range in the X axis direction" in embodiments 1 through 5.

Here, the "ejectable range in the X axis direction of the target sections 18R" is explained with reference to FIG. 8. As shown in FIG. 8, if the ejection nozzle 118T is positioned inside the ejectable range XE in the X axis direction of the target section 18 R, the droplet D can normally land in the target section 18R. On the contrary, if the ejection nozzle 118T is positioned outside the ejectable range XE in the X axis direction, the droplet D from the ejection nozzle 118T cannot normally land in the target section 18R. For example, as shown in FIG. 8, the droplet D from the ejection nozzle 118T may collide with the bank 16 before landing on the target section 18R. The length of the ejectable range XE in the X axis direction can be changed depending on the size of the droplet D to be ejected.

The length of the ejectable range XE in the X axis direction of the target section 18R is equal to or less than the length of the range EXT in the X coordinate of the target section 18R. Note that the "X coordinate range EXT of the target section 18R" means the range from the end of the target section 18R in the X axis direction to the other end thereof. In the present embodiment, the length of the "X coordinate range EXT of the target section 18R" is equal to the length of the longer side of the target section 18R.

In the present specification, the ejection nozzles 118T positioned inside the ejectable range XE in the X axis direction of the target section 18R may simply be denoted as "ejection nozzles 118T corresponding to the target section 18R."

The control section 112 commences the first scan period. Specifically, the scan section changes the relative position of the head 114 to the stage 106 towards the positive direction on the Y axis (right to left in FIG. 6) in response to the signal supplied from the control section 112 during the first scan period. The relative x coordinate of the head 114 is maintained to x1 during the first scan period. According to these conditions, each of the ejection nozzles 118T belonging to the first nozzle groups GA reaches an area corresponding to the target section 18R.

When the ejection nozzles 118T belonging to the first nozzle groups GA reach the area corresponding to the target section 18R, the liquid color filter material 111R is ejected from the ejection nozzles 118T. In the present embodiment, each of the target sections 18R corresponds to five of the ejection nozzles 118T in the first scan period. Further, in the first scan period the liquid color filter material 111R is ejected to the corresponding target section 18R from these five ejection nozzles 118T.

In contrast, the ejection nozzles 118T (the nozzles N6, N12, N18) belonging to the second nozzle groups GB do not overlap the target section 18R at all in the first scan period. Therefore, no liquid color filter material 111R is ejected from the ejection nozzles 118T belonging to the second nozzle groups GB in the first scan period.

Here, the "scan period" means a period during which the relative position of the head 114 or the ejection head section 103 to the stage 106 is moved from one end of the scan range 134 to the other end thereof or from the other end to the one end in the Y axis direction. One scan period may be denoted as "one pass period."

Figure 26:
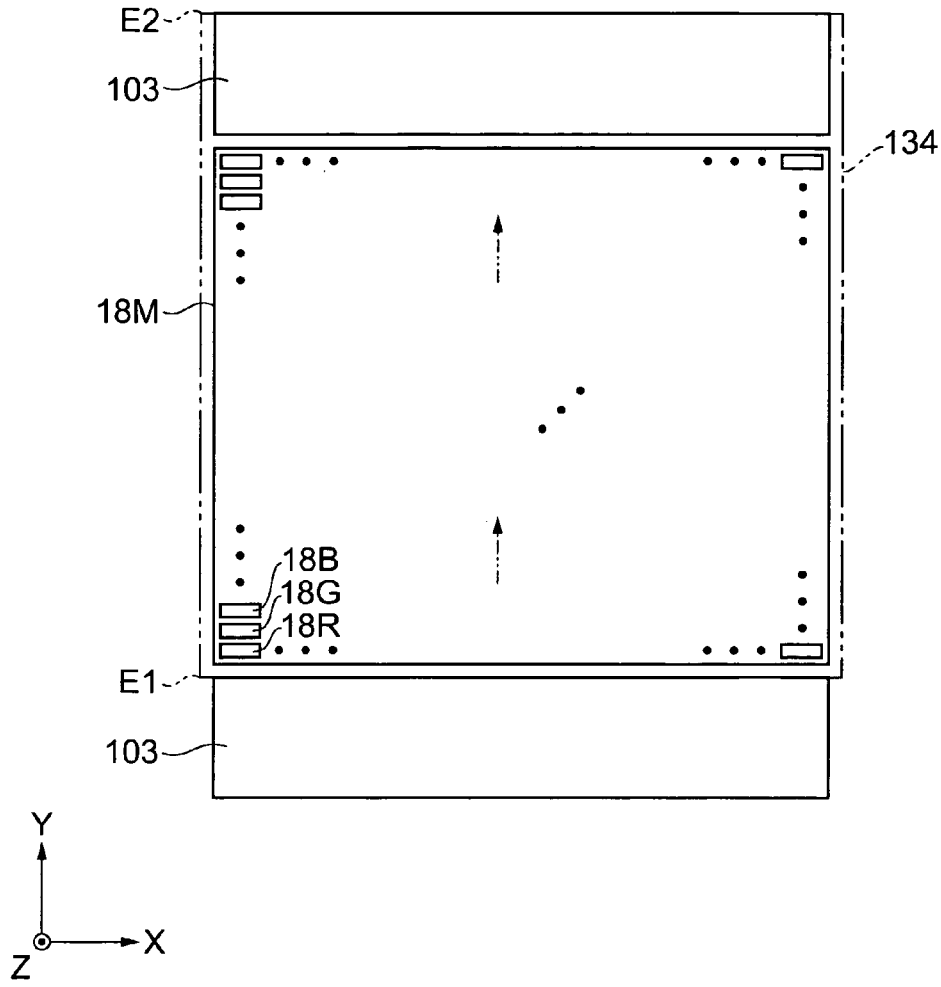
FIG. 26 is a schematic view for explaining a scan range of embodiment 1 through 5.

Note that the "scan range 134" means, referring to FIG. 26, a range in which one side of the ejection head section 103 is moved relative to the stage 106 so as to coat all the target sections 18R on the base body 10A with the material. Therefore, all the target sections 18R are covered with the scan range 134. In the present embodiment, the ejection head section 103 moves through the scan range 134 during one scan period.

Note that, according to the circumstances, the term "scan range" means a range in which one of the nozzles 118 (shown in FIG. 2) moves relative to the stage 106, a range in which one of the nozzle trains 116A, 116B (shown in FIG. 2) moves relatively, or a range in which the head 114 (shown in FIG. 2) moves relatively.

Further, that the ejection head section 103, the head 114 (shown in FIG. 2), or the nozzles 118 (shown in FIG. 2) are moved relative to the stage 106 means that the relative positions thereof to the stage 106, base body 10A, or the target sections 18R are changed. Therefore, in the present specification, even in case the ejection head section 103, the heads 114, or the nozzles 118 are stationary to the ejection device 100R while only the stage 106 moves, it is denoted that the ejection head section 103, the heads 114, or the nozzles 118 move relative to the stage 106, the base body 10A, or the target sections 18R. Further, the combination of relative scanning or the relative movement and the ejection of material may be denoted as a "coating scan."

Relative Movement in the X Axis Direction (Line Feed)

When the first scan period is terminated, the scan section moves the head 114 relatively in the X axis direction in response to the signal from the control section 112 so as to change the relative x coordinate of the head 114 from x1 to x2.

When the relative x coordinate of the head 114 becomes x2, all the ejection nozzles 118T belonging to the second nozzle groups GB are positioned inside the ejectable range in the X axis direction of the target section 18R. Here, when the relative x coordinate of the head 114 is x2, it does not matter whether or not the ejection nozzles 118T belonging to the first nozzle groups GA are positioned inside the ejectable range in the X axis direction of the target section 18R.

Figure 7:
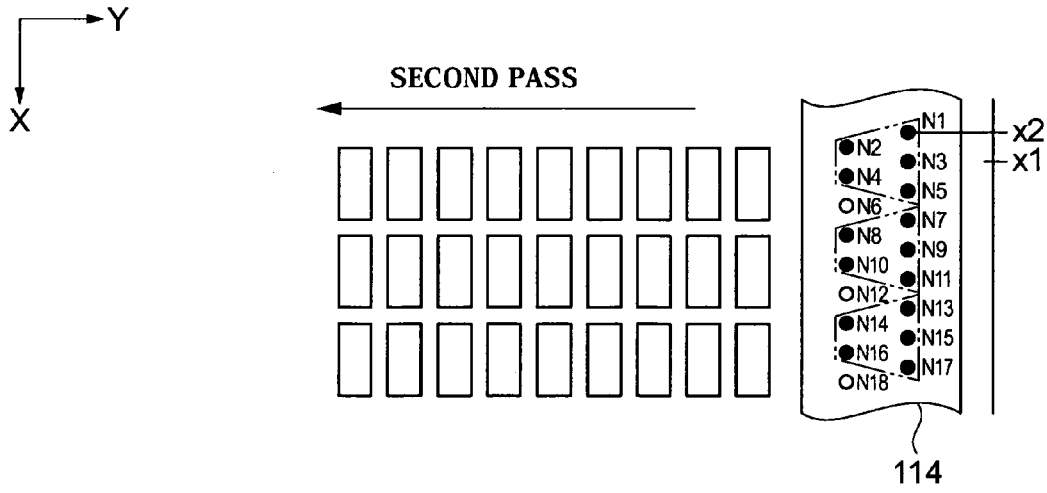
FIG. 7 is a schematic view showing a coating process of embodiment 1, in particular, a schematic view showing a second scan period to the base body.

As shown in FIG. 7, the nozzle N6 forming the second nozzle group GB is positioned inside the ejectable range in the X axis direction of the upper right target section 18R. At the same time, the nozzles N3, N4, and N5 out of the nozzles forming the first nozzle group GA are positioned inside the ejectable range in the X axis direction of the upper right target section 18R. In contrast, the nozzles N1 and N2 out of the nozzles forming the first nozzle groups GA are not positioned to the position corresponding to the target section 18R. Namely, in the second scan period commenced after the first scan period has been terminated, four ejection nozzles 118T correspond to one target section 18R. Further, in the second scan period, the liquid color filter material 111R is ejected to the corresponding target section 18R from these four ejection nozzles 118T. Furthermore, the four ejection nozzles 118T used in the second scan period include the ejection nozzle 118T not used in the first scan period.

Further, by changing the relative position to the stage 106 so that the relative x coordinate of the head 114 becomes x1 and x2, all the ejection nozzles 118T distributed in the nozzle distribution range EXT can be positioned inside the ejectable range in the X axis direction of the target section 18R in either the first scan period or the second scan period. Namely, all the ejection nozzles 118T distributed in the nozzle distribution range EXT can eject the color filter material 111R.

Second Scan Period

Subsequently, as shown in FIG. 7, the control section 112 commences the second scan period. Specifically, the scan section changes the relative position of the head 114 to the stage 106 towards the negative direction on the Y axis (left to right in FIG. 7) in response to the signal supplied from the control section 112 during the second scan period. The relative x coordinate of the head 114 is maintained to x2 during the second scan period. According to these conditions, each of the ejection nozzles 118T belonging to the second nozzle groups GB reaches the area corresponding to the target section 18R. When the ejection nozzles 118T belonging to the second nozzle groups GB reaches the area corresponding to the target section 18R, the color filter material 111R is ejected from each of the ejection nozzles 118T belonging to the second nozzle groups GB. Further, the color filter material 111R is also ejected in the second scan period from the ejection nozzles 118T positioned in the ejectable range in the X axis direction of the target section among the ejection nozzles 118T belonging to the first nozzle groups GA, as is the case with the ejection nozzle 118T belonging to the second nozzle groups GB.

According to the present embodiment, the life of the head 114 can be extended. This is because it is possible to make the ejection nozzles 118T (the ejection nozzles 118T belonging to the second nozzle groups GB) not corresponding to the target section 18R share the burden of ejecting the color filter material 111R.

Further, according to the present embodiment, the coating process can proceed while maintaining the ejection stability of the ejection device 100R. This is because none of the ejection nozzles 118T is idle (do not perform any ejection) for a long interval since all the ejection nozzles 118T of the heads 114 eject droplets D of the color filter material 111R in at least one of the first scan period and the second scan period. Therefore, the material is prevented from becoming hard in the nozzles during the coating process.

Embodiment 2

In embodiment 1, the process of coating the color filter material 111R on the target sections 18R is explained. Hereinafter, a series of processes to obtain the color filter substrate 10 using the manufacturing device 1 will be described.

Figure 5:
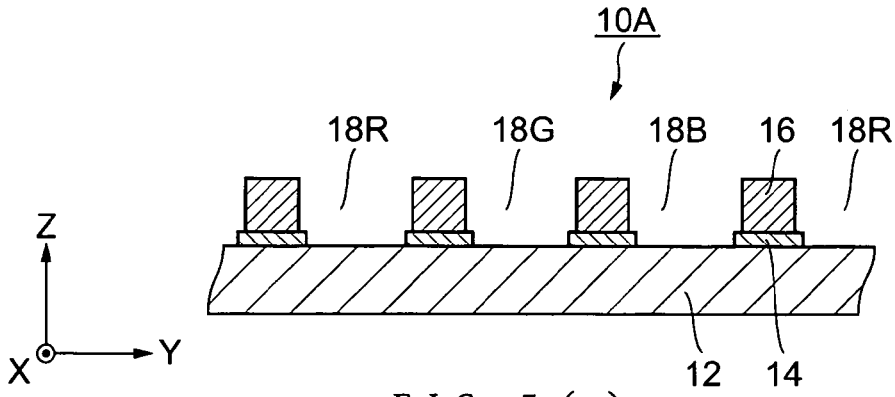
FIG. 5(A) is a schematic view showing a cross-section of a base body of embodiment 1.
FIG. 5(B) is a schematic view showing an upper surface of the base body of embodiment 1.
Figure 5:
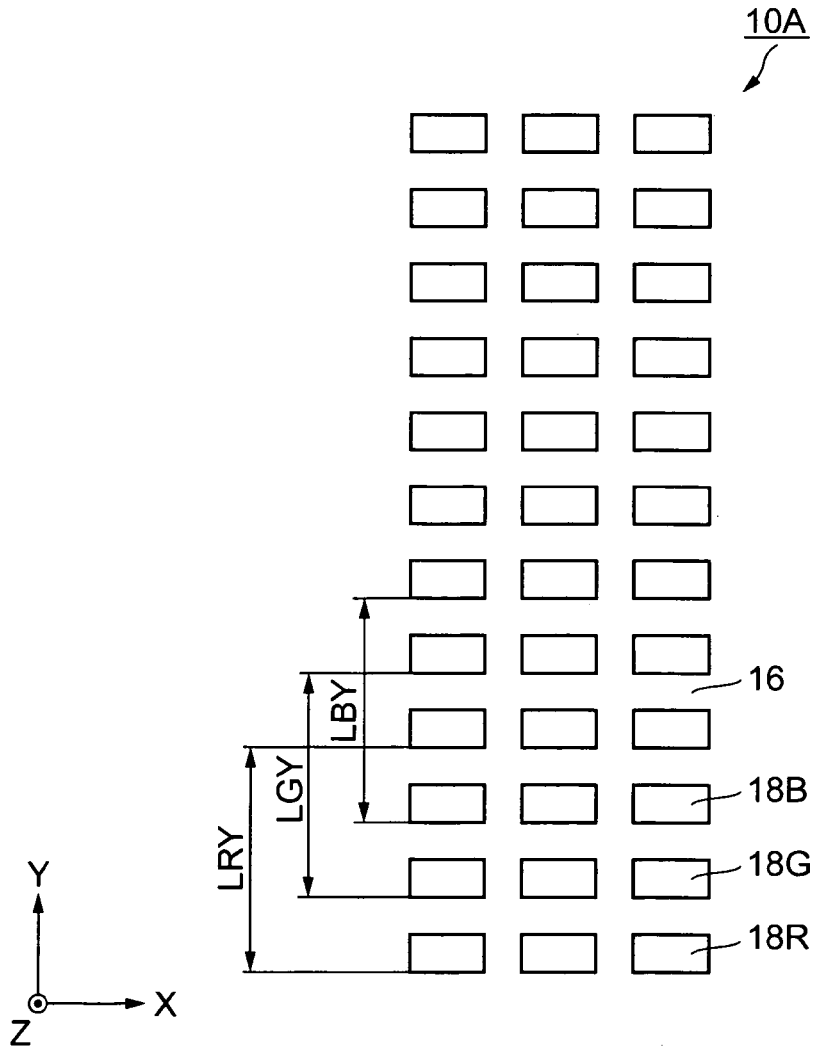
Figure 9:
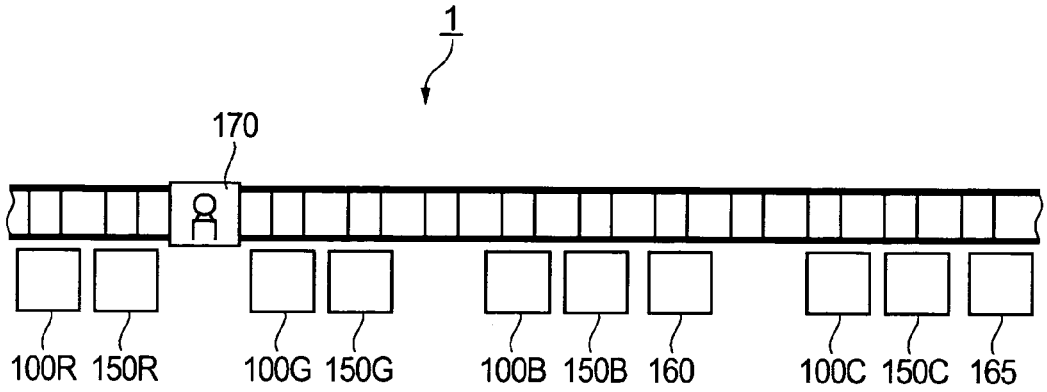
FIG. 9 is a schematic view showing a manufacturing device of a color filter substrate of an embodiment 2.

The manufacturing device 1 shown in FIG. 9 is a device for ejecting corresponding color filter materials to respective target sections 18R, 18G, and 18B of the base body 10A shown in FIG. 5. Specifically, the manufacturing device 1 is equipped with the ejection device 100R for coating the color filter material 111R on each of the target sections 18R, a drying device 150R for drying the color filter material 111R on the target sections 18R, an ejection device 100G for coating the color filter material 111G on each of the target sections 18G, a drying device 150G for drying the color filter material 111G on the target sections 18G, an ejection device 100B for coating the color filter material 111B on each of the target sections 18B, a drying device 150B for drying the color filter material 111B on the target sections 18B, an oven 160 for reheating (post-baking) the color filter materials 111R, 111G, and 111B, an ejection device 100C for providing a protective film 20 on the layer of the color filter materials 111R, 111G, and 111B which have been post-baked, a drying device 150C for drying the protective film 20, and a curing device 165 for reheating to cure the dried protective film 20. Further, the manufacturing device 1 is also equipped with a carrying device 170 to carry the base body 10A to the ejection device 100R, the drying device 150R, the ejection device 100G, the drying device 150G, the ejection device 100B, the drying device 150B, the ejection device 100C, the drying device 150C, and the curing device 165 in this order. The carrying device 170 is equipped with a fork section, a drive section for moving the fork section up and down, and a self-propelled section.

Since the configuration of the ejection device 100R has already been described in embodiment 1, the description will be omitted here. The configurations of the ejection devices 100G, 100B, and 100C are basically the same as the configuration of the ejection device 100R. Note that the configuration of the ejection device 100G differs from the configuration of the ejection device 100R in that it is equipped with a tank and a tube dedicated to the color filter material 111G instead of the tank 101R and the tube 110R in the ejection device 100R. Likewise, the configuration of the ejection device 100B differs from the configuration of the ejection device 100R in that it is equipped with a tank and a tube dedicated to the color filter material 111B instead of the tank 101R and the tube 110R. Further, the configuration of the ejection device 100C differs from the configuration of the ejection device 100R in that it is equipped with a tank and a tube dedicated to the protective film material instead of the tank 101R and the tube 110R. Note that each of the liquid color filter materials 111R, 111G, and 111Bin the present embodiment is an example of "liquid materials" of the present invention.

First, the base body 10A shown in FIG. 5 is manufactured along the following processes. At first, a metal thin film is formed on the support substrate 12 using a sputter process or a vapor deposition process. Then, the black matrix 14 having a lattice shape is formed from the metal thin film using a photolithography process. An example of a material of the black matrix 14 is chromium metal or chromium oxide. Note that the support substrate 12 is a substrate having light translucency with respect to visible light, such as for example, a glass substrate. Subsequently, a resist layer made of a negative type photosensitive resin compound is coated so as to cover the support substrate 12 and the black matrix 14. Then, the resist layer is exposed while contacting a mask film formed as the matrix pattern closely on the resist layer. Thereafter, by removing the non-exposed portion of the resist layer with an etching process, the bank 16 can be obtained. The base body 10A can be obtained through the above processes.

Note that a bank made of resin black can be used instead of the bank 16. In this case, the metal thin film (the black matrix 14) is not necessary, and the bank layer is composed of a single layer.

Then, lyophilicity is provided to the base body 10A using an oxygen plasma process under atmospheric pressure. By this process, a surface of the support substrate 12 in each of the hollow sections (a part of a pixel area) defined by the support substrate 12, the black matrix 14, and the bank 16, in addition to the surface of the black matrix 14, and the surface of the bank 16 become lyophilic. Further, thereafter, another plasma process using tetrafluoromethane as reactive gas is executed on the base body 10A. By the plasma process using tetrafluoromethane, the surface of the bank 16 in each of the hollow sections is fluoridized (treated to have lyophobicity), thus the surface of the bank 16 becomes lyophobic. Note that, although the surface of the support substrate 12 and the surface of the black matrix 14 previously provided with lyophilicity slightly lose their lyophilicity to some extent by the plasma process using tetrafluoromethane, these surfaces are still maintained to be lyophilic. As describes above, by executing a predetermined surface treatment on the surfaces of the hollow sections defined by the support substrate 12, the black matrix 14, and the bank 16, the surfaces of the hollow sections are prepared to be the target sections 18R, 18G, and 18B.

Note that, depending on materials of the support substrate 12, black matrix 14, or the bank 16, the surfaces with required lyophilicity or lyophobicity may be obtained without the surface treatments described above. In such cases, without the treatments described above, the surfaces of the hollow sections defined by the support substrate 12, the black matrix 14, and the bank 16 are already prepared to be the target sections 18R, 18G, and 18B.

Figure 10:
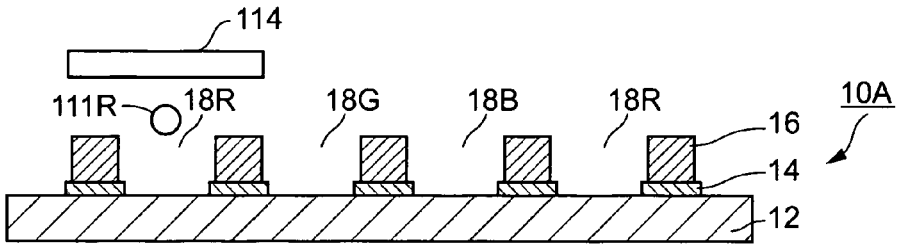
FIGS. 10(A) through 10(D) are views for explaining a manufacturing method of the color filter of embodiment 2.
Figure 10:
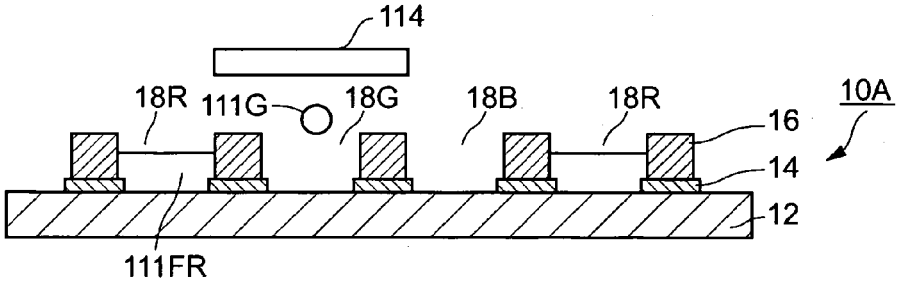
Figure 10:
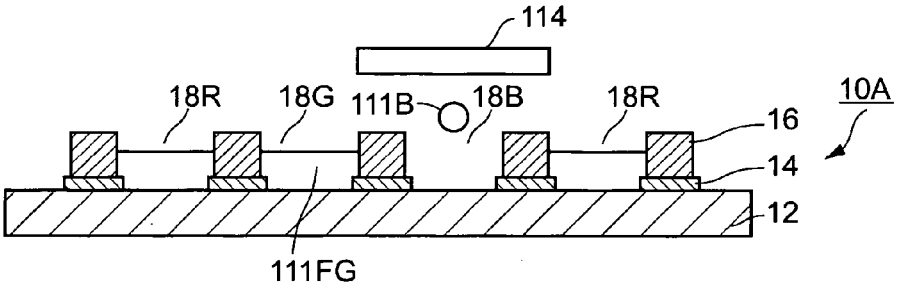
Figure 10:
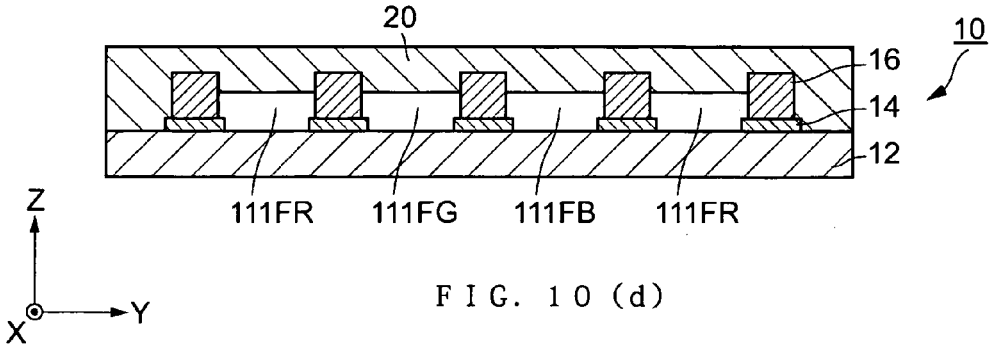

The base body 10A provided with the target sections 18R, 18G, and 18B is transferred to the stage 106 of the ejection device 100R by the carrying device 170. Then, as shown in FIG. 10(A), the ejection device 100R ejects the color filter material 111R from the head 114 in accordance with the signal from the control section 112 so as to form layers of the color filter material 111R on all of the target sections 18R. More specifically, the ejection device 100R coats each of the plurality of target sections 18R with the color filter material 111R by executing the coating process described in embodiment 1.

When the layers of the color filter material 111R are formed on all of the target sections 18R of the base body 10A, the carrying device 170 positions the base body 10A inside the drying device 150R. Then, by sufficiently drying the color filter material 111R on the target sections 18R, the filter layers 111FR are obtained on the target sections 18R.

Subsequently, the carrying device 170 positions the base body 10A on the stage 106 of the ejection device 100G. Then, as shown in FIG. 10(B), the ejection device 100G ejects the color filter material 111G from the head 114 in accordance with the signal from the control section 112 so as to form layers of the color filter material 111G on all of the target sections 18G. More specifically, the ejection device 100G coats each of the plurality of target sections 18G with the color filter material 111G by executing the coating process described in embodiment 1.

When the layers of the color filter material 111G are formed on all of the target sections 18G of the base body 10A, the carrying device 170 positions the base body 10A inside the drying device 150G. Then, by sufficiently drying the color filter material 111G on the target sections 18G, the filter layers 111FG are obtained on the target sections 18G.

Subsequently, the carrying device 170 positions the base body 10A on the stage 106 of the ejection device 100B. Then, as shown in FIG. 10(C), the ejection device 100B ejects the color filter material 111B from the head 114 in accordance with the signal from the control section 112 so as to form layers of the color filter material 111B on all of the target sections 18B. More specifically, the ejection device 100B coats each of the plurality of target sections 18B with the color filter material 111B by executing the coating process described in embodiment 1.

When the layers of the color filter material 111B are formed on all of the target sections 18B of the base body 10A, the carrying device 170 positions the base body 10A inside the drying device 150B. Then, by sufficiently drying the color filter material 111B on the target sections 18B, the filter layers 111FB are obtained on the target sections 18B.

Subsequently, the carrying device 170 positions the base body 10A inside the oven 160. Thereafter, the oven 160 reheats (post-bakes) the filter layers 111FR, 111FG, and 111FB.

Subsequently, the carrying device 170 positions the base body 10A on the stage 106 of the ejection device 100C. Then, the ejection device 100C ejects liquid protective film material so as to form the protective film 20 covering the filter layers 111FR, 111FG, and 111FB, and the bank 16. After the protective film 20 covering the filter layers 111FR, 111FG, and 111FB and the bank 16 is formed, the carrying device 170 positions the base body 10A in the oven 150C. Then, the oven 150C sufficiently dries the protective film 20, and then the curing device 165 heats to completely cure the protective layer 20, thus the base body 10A becomes the color filter substrate 10.

According to the present embodiment, the lives of the heads 114 of the ejection devices 100R, 100G, and 100B can be extended. This is because it is possible to make the ejection nozzles 118T (the ejection nozzles 118T belonging to the second nozzle groups GB) not corresponding to the target sections 18R, 18G, 18B share the burden of ejecting the color filter materials 111R, 111G, 111B.

Further, according to the present embodiment, the coating process can proceed while maintaining the stability of the manufacturing device 1. Since all of the ejection nozzles 118T of the heads 114 in the ejection devices 100R, 100G, 100B eject droplets D of the color filter material in at least one of the first scan period and the second scan period, as a result, none of the ejection nozzles 118T is idle (do not perform any ejection) for a long interval. Therefore, the material can be prevented from becoming hard in the nozzles during the coating process.

Embodiment 3

Hereinafter, an example of the manufacturing device for an electroluminescence display device applying the present invention will be described.

The base body 30A shown in FIGS. 11(A) and 11(B) is a substrate to be formed as an electroluminescence display device 30 through processes by a manufacturing device 2 (shown in FIG. 12) described below. The base body 30A includes a plurality of target sections 38R, 38G, and 38B arranged in a matrix.

Specifically, the base body 30A comprises a support substrate 32, a circuit component layer 34 formed on the support substrate 32, a plurality of pixel electrodes 36 formed on the circuit component layer 34, and a bank 40 formed between the plurality of pixel electrodes 36. The support substrate is a substrate having light translucency with respect to visible light, such as for example, a glass substrate. Each of the plurality of pixel electrodes 36 is a electrode having light translucency with respect to visible light, such as for example, an ITO (Indium-Tin Oxide) electrode. Further, the plurality of pixel electrodes 36 is disposed on the circuit component layer 34 in a matrix, each defining a pixel area. The bank 40 has a lattice shape to surround each of the plurality of pixel electrodes 36. Further, the bank 40 is composed of an inorganic bank 40A formed on the circuit component layer 34, and an organic bank 40B positioned on the inorganic bank 40A.

The circuit component layer 34 is a layer comprising a plurality of scan electrodes provided on the support substrate 32 and extending in a predetermined direction, a insulation film 42 formed to cover the plurality of scan electrodes, a plurality of signal electrodes positioned on the insulation film 42 and extending in a direction perpendicular to the direction along which the scan electrodes extend, a plurality of switching elements 44 positioned adjacent to the intersections of the scan electrodes and the signal electrodes, an interlayer insulation film 45 formed of polyimide or the like to cover the plurality of switching element 44. The gate electrode 44G and the source electrodes 44S of each of the switching elements 44 are electrically connected to the corresponding scan electrode and the corresponding signal electrode, respectively. On the interlayer insulation film 45, there is positioned the plurality of pixel electrodes 36. The interlayer insulation layer 45 is provided with through holes 44V at positions corresponding to the drain electrode 44D of each of the switching elements 44, the electrical connections between the switching elements 44 and the corresponding pixel electrodes 36 being established via these through holes 44V. Further, each of the switching elements 44 is positioned at a position corresponding to the bank 40. In other words, in an observation from a direction perpendicular to the sheet of FIG. 11(B), each of the plurality of switching elements 44 is positioned to be covered by the bank 40.

The hollow sections (a part of the pixel area) defined by the base body 30A, the pixel electrode 36, and the bank 40 correspond to the target sections 38R, 38G, and 38B. The target section 38R is an area where a light emitting layer 211FR for emitting light beams in the red wavelength band is to be formed, the target section 38G is an area where a light emitting layer 211FG for emitting light beams in the green wavelength band is to be formed, and the target section 38B is an area where a light emitting layer 211FB for emitting light beams in the blue wavelength band is to be formed.

The base body 30A shown in FIG. 11(B) is positioned on a virtual plane parallel to both the X axis direction and the Y axis direction. A row direction and a column direction of the matrix formed of the plurality of target sections 38R, 38G, and 38B are parallel to the X axis direction and the Y axis direction, respectively. In the base body 30A, the target sections 38R, the target sections 38G, and the target sections 38B are aligned in the Y axis direction periodically in this order. Meanwhile, the target sections 38R are aligned in a line in the X axis direction with a predetermined interval, the target sections 38G are aligned in a line in the X axis direction with a predetermined interval, and the target sections 38B are also aligned in a line in the X axis direction with a predetermined interval. Note that the X axis direction and the Y axis direction are perpendicular to each other.

An interval LRY of the target sections 38R along the Y axis direction, namely the pitch thereof is about 560 μm. The interval is equal to the interval LGY of the target sections 38G along the Y axis direction, and also to the interval LBY of the target sections 38B along the Y axis direction. Further, the planar image of the target section 38R is a rectangle decided by longer sides and shorter sides. Specifically, the length of the target section 38R in the Y axis direction is about 100 μm, and the length thereof in the X axis is about 300 μm. The target sections 38G and the target sections 38B have the same shapes and sizes as the target sections 38R. The intervals of the target sections and the sizes of the target sections correspond to the intervals and the sizes of the pixels of the same color in a high resolution digital television of about 40 inches.

Figure 11:
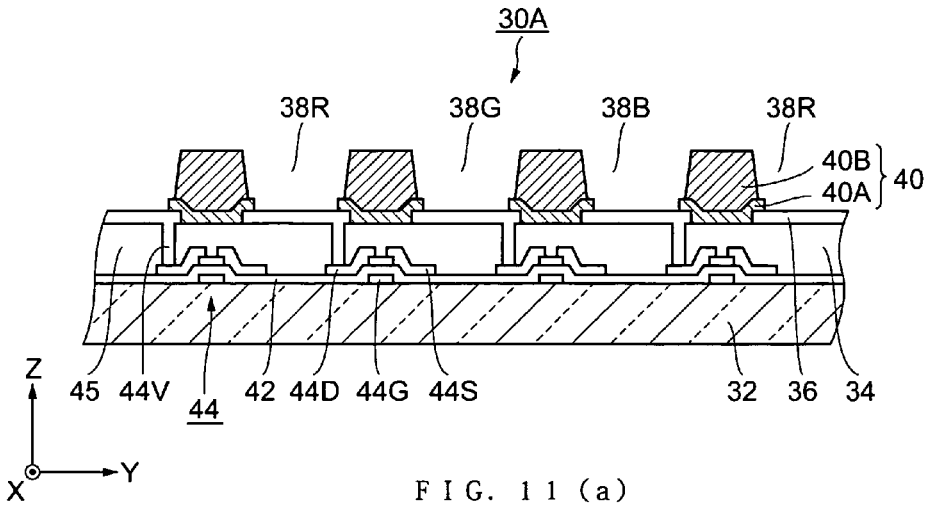
FIG. 11(A) is a schematic view showing a cross-section of a base body of an embodiment 3.
FIG. 11(B) is a schematic view showing an upper surface of the base body of embodiment 3.
Figure 11:
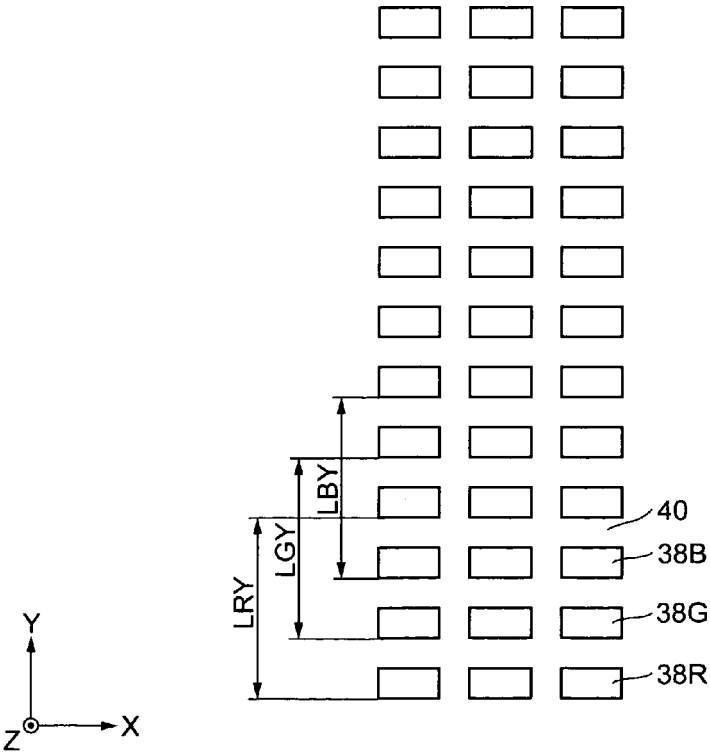
Figure 12:
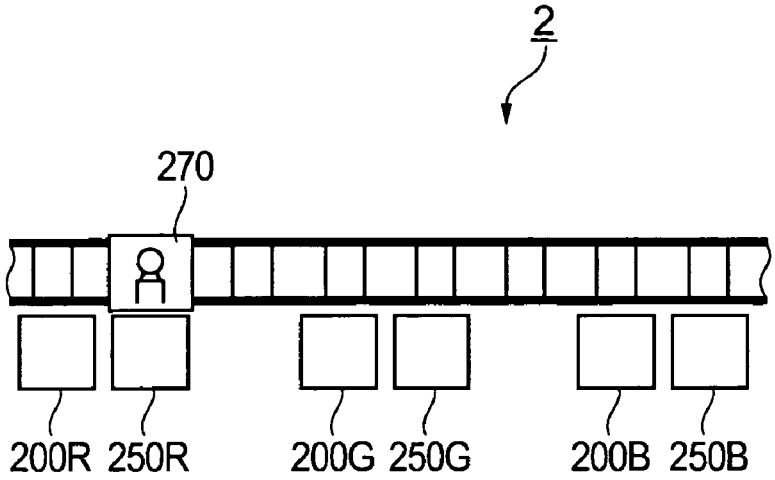
FIG. 12 is a schematic view showing a manufacturing device of an electroluminescence display device of embodiment 3.

The manufacturing device 2 shown in FIG. 12 is a device for ejecting corresponding light emitting materials to respective target sections 38R, 38G, and 38B of the base body 30A shown in FIG. 11. The manufacturing device 2 is equipped with an ejection device 200R for coating all of the target sections 38R with the light emitting material 211R, a drying device 250R for drying the light emitting material 211R on the target sections 38R, an ejection device 200G for coating all of the target sections 38G with the light emitting material 211G, a drying device 250G for drying the light emitting material 211G on the target sections 38G, an ejection device 200B for coating all of the target sections 38B with the light emitting material 211B, and a drying device 250B for drying the light emitting material 211B on the target sections 38B. Further, the manufacturing device 2 is also equipped with a carrying device 270 to carry the base body 30A to the ejection device 200R, the drying device 250R, the ejection device 200G, the drying device 250G, the ejection device 200B, and the drying device 250B in this order. The carrying device 270 is equipped with a fork section, a drive section for moving the fork section up and down, and a self-propelled section.

Figure 13:
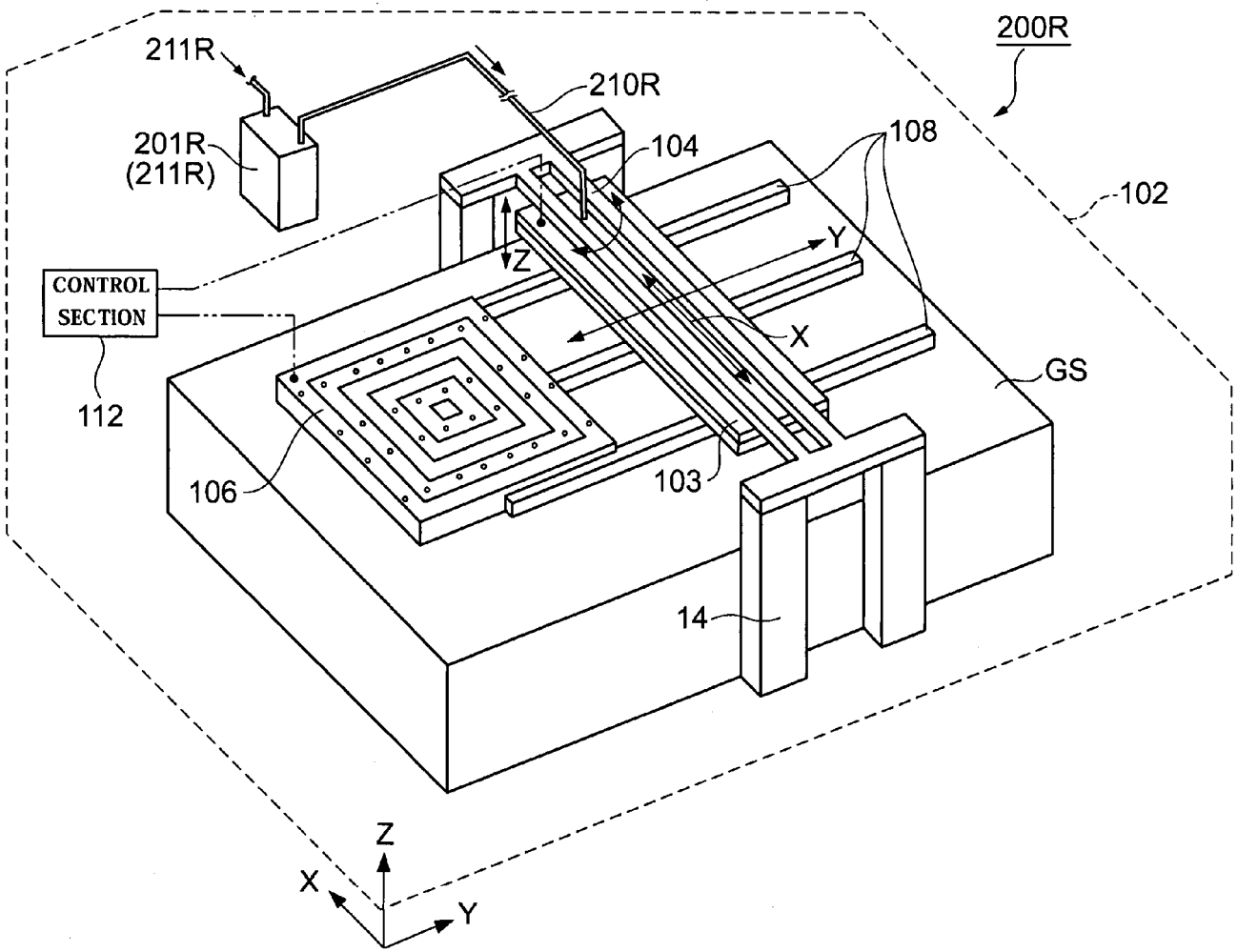
FIG. 13 is a schematic view showing an ejection device of embodiment 3.

The ejection device 200R shown in FIG. 13 is equipped with a tank 201R for containing the liquid light emitting material 211R, a tube 210R, and an ejection scanning section 102 to which the liquid light emitting material 211R is supplied from the tank 201R via the tube 210R. Since the configuration of the ejection scanning section 102 is the same as the ejection scanning section 102 (shown in FIG. 1) of embodiment 1, the same configuration elements are provided with the same reference numerals, and duplicated descriptions will be omitted. Further, the configurations of the ejection devices 200G and 200B are basically the same as the configuration of the ejection device 200R. Note that the configuration of the ejection device 200G differs from the configuration of the ejection device 200R in that it is equipped with a tank and a tube dedicated to the light emitting material 211G instead of the tank 201R and the tube 210R. Likewise, the configuration of the ejection device 200B differs from the configuration of the ejection device 200R in that it is equipped with a tank and a tube dedicated to the light emitting material 211B instead of the tank 201R and the tube 210R. Note that each of the liquid light emitting materials 211R, 211B, and 211G in the present embodiment is an example of "liquid materials" of the present invention.

A method of manufacturing the electroluminescence display device 30 using the manufacturing device 2 will be described. First, the base body 30A shown in FIG. 11 is manufactured using a film forming technology and a patterning technology known to the public.

Then, lyophilicity is provided to the base body 30A using an oxygen plasma process under atmospheric pressure. By this process, a surface of the pixel electrode 36 in each of the hollow sections (a part of a pixel area) defined by the pixel electrodes 36 and the bank 40, in addition to the surface of the inorganic bank 40A and the surface of the organic bank 40B become lyophilic. Further, thereafter, another plasma process using tetrafluoromethane as reactive gas is executed on the base body 30A. By the plasma process using tetrafluoromethane, the surface of the organic bank 40B in each of the hollow sections is fluoridized (treated to have lyophobicity), thus the surface of the organic bank 40B becomes lyophobic. Note that, although the surfaces of the pixel electrodes 36 and the surfaces of the inorganic bank 40A previously provided with lyophilicity slightly lose their lyophilicity to some extent by the plasma process using tetrafluoromethane, these surfaces are still maintained to be lyophilic. As describes above, by executing a predetermined surface treatment on the surfaces of the hollow sections defined by the pixel electrodes 36 and the bank 40, the surfaces of the hollow sections are prepared to be the target sections 38R, 38G, and 38B.

Note that, depending on materials of the pixel electrodes 36, the inorganic bank 40A, or the organic bank 40B, the surfaces with required lyophilicity or lyophobicity may be obtained without the surface treatments described above. In such cases, without the surface treatments described above, the surfaces of the hollow sections defined by the pixel electrodes 36 and the bank 40 are already prepared to be the target sections 38R, 38G, and 38B.

In this case, above each of the plurality of pixel electrodes 36 provided with the surface treatments, hole transport layers 37R, 37G, 37B corresponding thereto can be formed. By positioning the hole transport layers 37R, 37G, 37B between the pixel electrodes 36 and the light emitting layers 211FR, 211FG, 211FB, light emitting efficiency of the electroluminescence display device is enhanced. If the hole transport layers are provided above each of the plurality of pixel electrodes 36, the hollow sections defined by the hole transport layers and the bank 40 correspond to the target sections 38R, 38G, and 38B.

Note that the hole transport layers 37R, 37G, 37B can be formed using an inkjet process. In this case, the hole transport layers can be formed by coating each pixel area with a predetermined amount of solution including the material for forming the hole transport layers 37R, 37G, 37B and then drying them.

Figure 14:
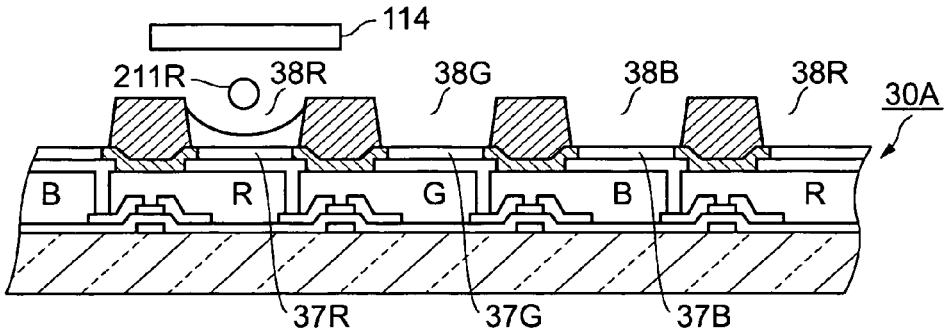
FIGS. 14(A) through 14(D) are views for explaining a manufacturing method of the electroluminescence display device of embodiment 3.
Figure 14:
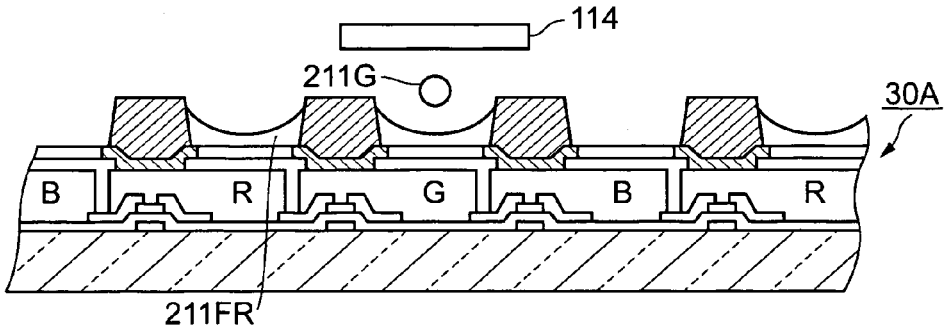
Figure 14:
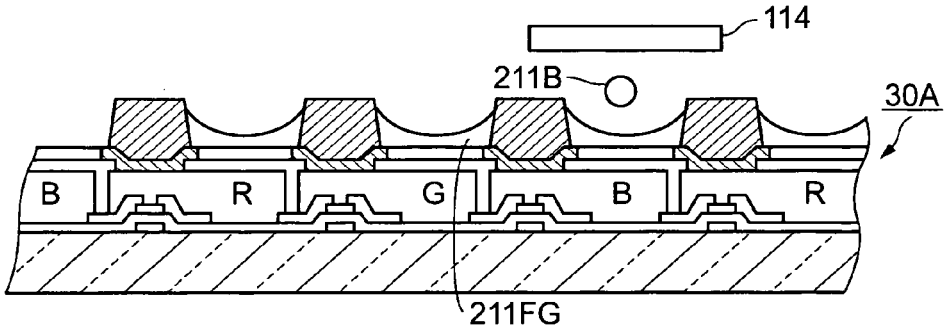
Figure 14:
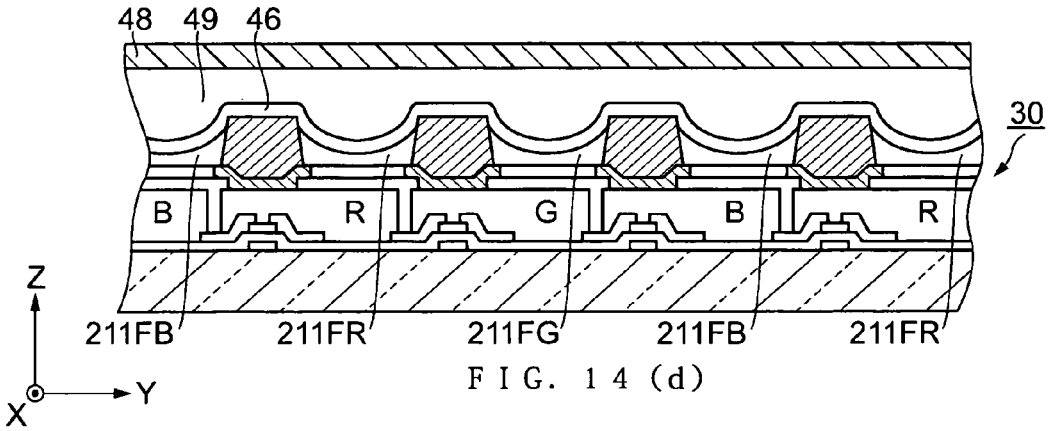

The base body 30A provided with the target sections 38R, 38G, and 38B is transferred to the stage 106 of the ejection device 200R by the carrying device 270. Then, as shown in FIG. 14(A), the ejection device 200R ejects the light emitting material 211R from the head 114 in accordance with the signal from the control section 112 so as to form layers of the light emitting material 211R on all of the target sections 38R.

More specifically, the ejection device 200R coats each of the plurality of target sections 38R with the light emitting material 211R by executing the coating process described in embodiment 1.

When the layers of the light emitting material 211R are formed on all of the target sections 38R of the base body 30A, the carrying device 270 positions the base body 30A inside the drying device 250R. Then, by sufficiently drying the light emitting material 211R on the target sections 38R, the light emitting layers 211FR are obtained on the target sections 38R.

Subsequently, the carrying device 270 positions the base body 30A on the stage 106 of the ejection device 200G. Then, as shown in FIG. 14(A), the ejection device 200G ejects the light emitting material 211G from the head 114 in accordance with the signal from the control section 112 so as to form layers of the light emitting material 211G on all of the target sections 38G. More specifically, the ejection device 200G coats each of the plurality of target sections 38G with the light emitting material 211G by executing the coating process described in embodiment 1.

When the layers of the light emitting material 211G are formed on all of the target sections 38G of the base body 30A, the carrying device 270 positions the base body 30A inside the drying device 250G. Then, by sufficiently drying the light emitting material 211G on the target sections 38G, the light emitting layers 211FG are obtained on the target sections 38G.

Subsequently, the carrying device 270 positions the base body 30A on the stage 106 of the ejection device 200B. Then, as shown in FIG. 14(C), the ejection device 200B ejects the light emitting material 211B from the head 114 in accordance with the signal from the control section 112 so as to form layers of the light emitting material 211B on all of the target sections 38B. More specifically, the ejection device 200B coats each of the plurality of target sections 38B with the light emitting material 211B by executing the coating process described in embodiment 1.

When the layers of the light emitting material 211B are formed on all of the target sections 38B of the base body 30A, the carrying device 270 positions the base body 30A inside the drying device 250B. Then, by sufficiently drying the light emitting material 211B on the target sections 38B, the light emitting layers 211FB are obtained on the target sections 38B.

Subsequently, as shown in FIG. 14(D), an opposing electrode 46 is provided so as to cover the light emitting layers 211FR, 211FG, 211FB, and the bank 40. The opposing electrode 46 functions as a cathode.

Then, a sealing substrate 48 and the base body 30A are adhered in the periphery of the both to obtain the electroluminescence display device 30. Note that a gap between the sealing substrate 48 and the base body 30A is filled with an inactive gas 49.

In the electroluminescence display device 30, the light beams emitted from the light emitting layers 211FR, 211FG, 211FB are output through the pixel electrode 36, the circuit component layer 34, and the support substrate 32. Such an electroluminescence display device emitting light through the circuit component layer 34 is called a bottom-emission type of display device.

According to the present embodiment, the lives of the heads 114 of the ejection devices 200R, 200G, and 200B can be extended. This is because it is possible to make the ejection nozzles 118T (the ejection nozzles 118T belonging to the second nozzle groups GB) not corresponding to the target sections 38R, 38G, 38B share the burden of ejecting the light emitting materials 211R, 211G, 211B.

Further, according to the present embodiment, the coating process can proceed while maintaining the stability of the manufacturing device 2. Since all of the ejection nozzles 118T of the heads 114 in the ejection devices 200R, 200G, 200B eject droplets D of the light emitting materials in at least one of the first scan period and the second scan period, as a result, none of the ejection nozzles 118T is idle (do not perform any ejection) for a long interval. Therefore, the light emitting material can be prevented from becoming hard in the nozzles during the coating process.

Embodiment 4

Hereinafter, an example of the manufacturing device for a back board of a plasma display device applying the present invention will be described.

The base body 50A shown in FIGS. 15(A) and 15(B) is a substrate to be formed as a back board 50B of a plasma display device through processes by a manufacturing device 3 (shown in FIG. 16) described below. The base body 50A includes a plurality of target sections 58R, 58G, and 58B arranged in a matrix.

Specifically, the base body 50A includes support substrate 52, a plurality of address electrodes 54 formed like stripes on the support substrate 52, a dielectric glass layer 56 formed to cover the address electrodes 54, and a partition 60 having a lattice shape and defining a plurality of pixel areas. The plurality of pixel areas is disposed in a matrix, each of the columns of the matrix formed of the plurality of pixel areas corresponding to respective one of the plurality of address electrodes 54. Such a base body 50A can be made using a conventional screen printing process.

In each pixel area of the base body 50A, the hollow section defined by the dielectric glass layer 56 and the partition 60 corresponds to one of the target sections 58R, 58G, and 58B. The target section 58R is an area where a fluorescent layer 311FR for emitting light beams in the red wavelength band is to be formed, the target section 58G is an area where a fluorescent layer 311FG for emitting light beams in the green wavelength band is to be formed, and the target section 58B is an area where a fluorescent layer 311FB for emitting light beams in the blue wavelength band is to be formed.

The base body 50A shown in FIG. 15(B) is positioned on a virtual plane parallel to both the X axis direction and the Y axis direction. A row direction and a column direction of the matrix formed of the plurality of target sections 58R, 58G, and 58B are parallel to the X axis direction and the Y axis direction, respectively. In the base body 50A, the target sections 58R, the target sections 58G, and the target sections 58B are aligned in the Y axis direction periodically in this order. Meanwhile, the target sections 58R are aligned in a line in the X axis direction with a predetermined interval, the target sections 58G are aligned in a line in the X axis direction with a predetermined interval, and the target sections 58B are also aligned in a line in the X axis direction with a predetermined interval. Note that the X axis direction and the Y axis direction are perpendicular to each other.

An interval LRY of the target sections 58R along the Y axis direction, namely the pitch thereof is about 560 μm. The interval is equal to the interval LGY of the target sections 58G along the Y axis direction, and also to the interval LBY of the target sections 58B along the Y axis direction. Further, the planar image of the target section 58R is a rectangle decided by longer sides and shorter sides. Specifically, the length of the target section 58R in the Y axis direction is about 100 μm, and the length thereof in the X axis is about 300 μm. The target sections 58G and the target sections 58B have the same shapes and sizes as the target sections 58R. The intervals of the target sections and the sizes of the target sections correspond to the intervals and the sizes of the pixels of the same color in a high resolution digital television of about 40 inches.

Figure 15:
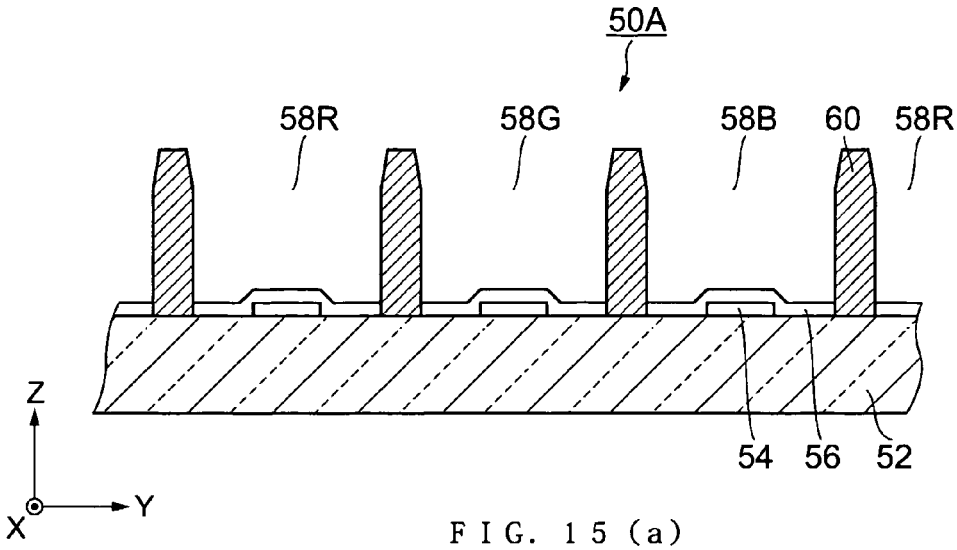
FIG. 15(A) is a schematic view showing a cross-section of a base body of an embodiment 4.
FIG. 15(B) is a schematic view showing an upper surface of the base body of embodiment 4.
Figure 15:
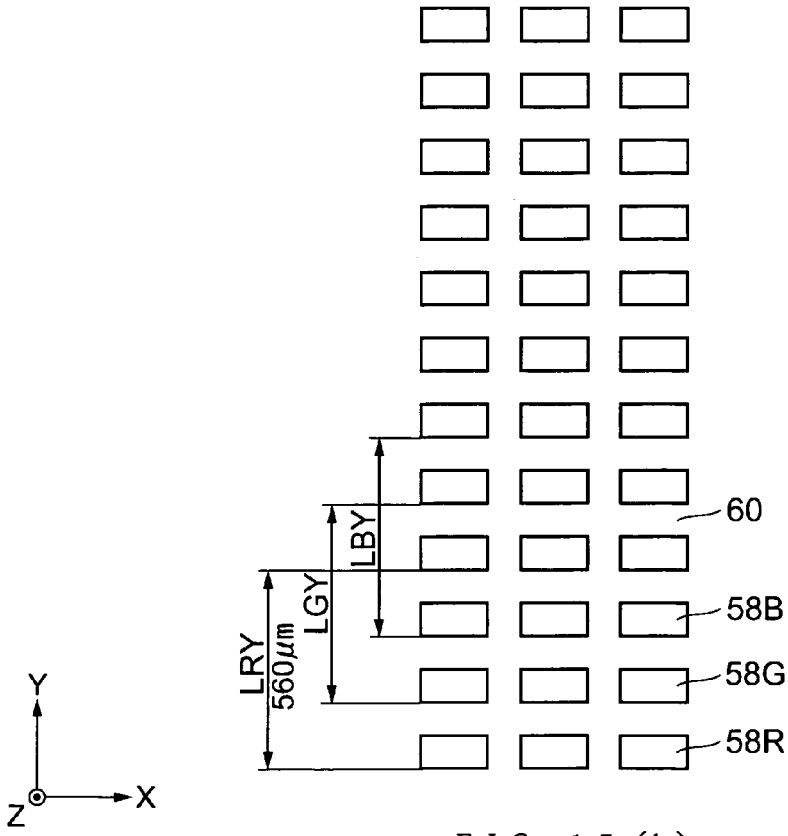
Figure 16:
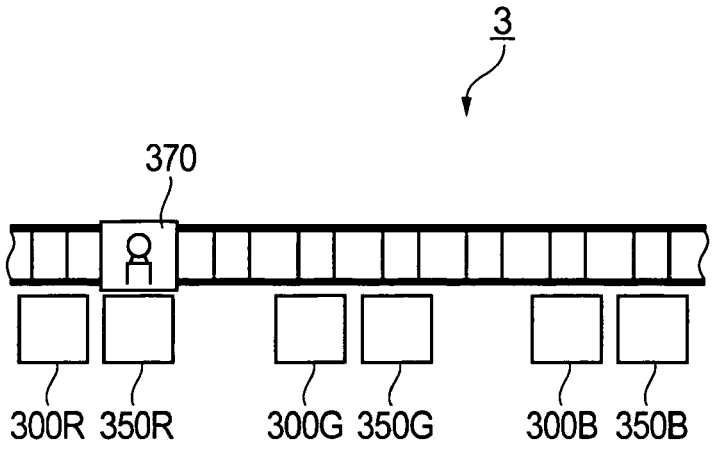
FIG. 16 is a schematic view showing a manufacturing device of a plasma display device of an embodiment 4.

The manufacturing device 3 shown in FIG. 16 is a device for ejecting corresponding fluorescent materials to respective target sections 58R, 58G, and 58B of the base body 50A shown in FIG. 15. The manufacturing device 3 is equipped with an ejection device 300R for coating all of the target sections 58R with the fluorescent material 311R, a drying device 350R for drying the fluorescent material 311R on the target sections 58R, an ejection device 300G for coating all of the target sections 58G with the fluorescent material 311G, a drying device 350G for drying the fluorescent material 311G on the target sections 58G, an ejection device 300B for coating all of the target sections 38B with the fluorescent material 311B, and a drying device 350B for drying the fluorescent material 311B on the target sections 58B. Further, the manufacturing device 3 is also equipped with a carrying device 370 to carry the base body 50A to the ejection device 300R, the drying device 350R, the ejection device 300G, the drying device 350G, the ejection device 300B, and the drying device 350B in this order. The carrying device 370 is equipped with a fork section, a drive section for moving the fork section up and down, and a self-propelled section.

Figure 17:
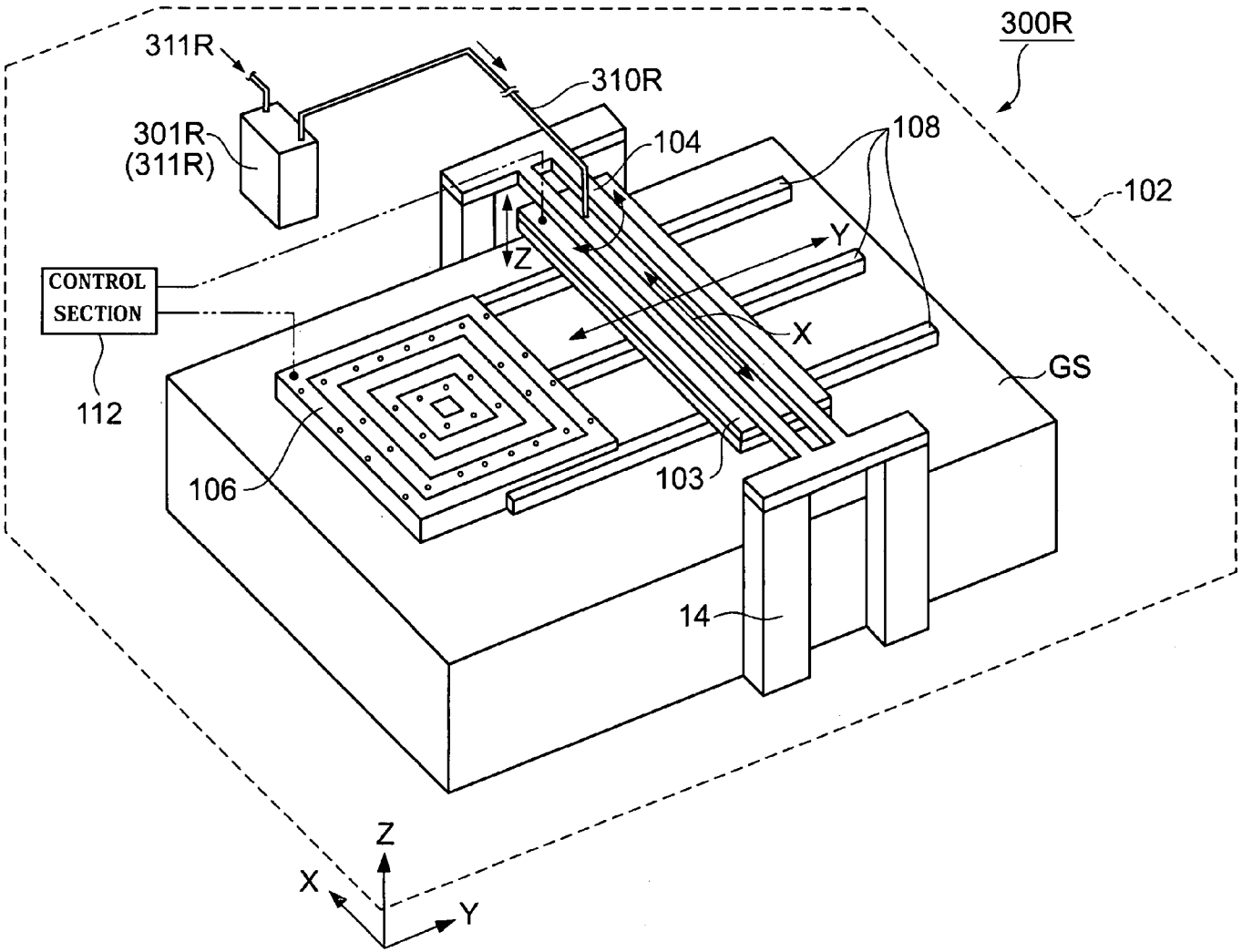
FIG. 17 is a schematic view showing an ejection device of embodiment 4.

The ejection device 300R shown in FIG. 17 is equipped with a tank 301R for containing the liquid fluorescent material 311R, a tube 310R, and an ejection scanning section 102 to which the liquid fluorescent material 311R is supplied from the tank 301R via the tube 310R. Since the configuration of the ejection scanning section 102 has already been described in embodiment 1, duplicated descriptions will be omitted here.

The configurations of the ejection devices 300G and 300B are basically the same as the configuration of the ejection device 300R. Note that the configuration of the ejection device 300G differs from the configuration of the ejection device 300R in that it is equipped with a tank and a tube dedicated to the fluorescent material 311G instead of the tank 301R and the tube 310R. Likewise, the configuration of the ejection device 300B differs from the configuration of the ejection device 300R in that it is equipped with a tank and a tube dedicated to the fluorescent material 311B instead of the tank 301R and the tube 310R. Note that each of the liquid fluorescent materials 311R, 311B, and 311G in the present embodiment is an example of "liquid materials" of the present invention.

A method of manufacturing the plasma display device using the manufacturing device 3 will be described. First, a plurality of address electrodes 54, a dielectric glass layer 56, a partition 60 are formed on the support substrate 52 using a conventional screen printing process to obtain the base body 50A shown in FIG. 15.

Then, lyophilicity is provided to the base body 50A using an oxygen plasma process under atmospheric pressure. According to this process, the surface of the partition 60 of each of the hollow sections defined by the partition 60 and the dielectric glass layer 56 as well as the surface of the dielectric glass layer 56 becomes lyophilic, thus these surfaces are prepared to be the target sections 58R, 58G, and 58B. Note that, in some cases, the surfaces with the required lyophilicity may be obtained depending on the materials thereof without executing the surface treatments described above. In such cases, without the surface treatments described above, the surfaces of the hollow sections defined by the partition 60 and dielectric glass layer 56 are already prepared to be the target sections 58R, 58G, and 58B.

Figure 18:
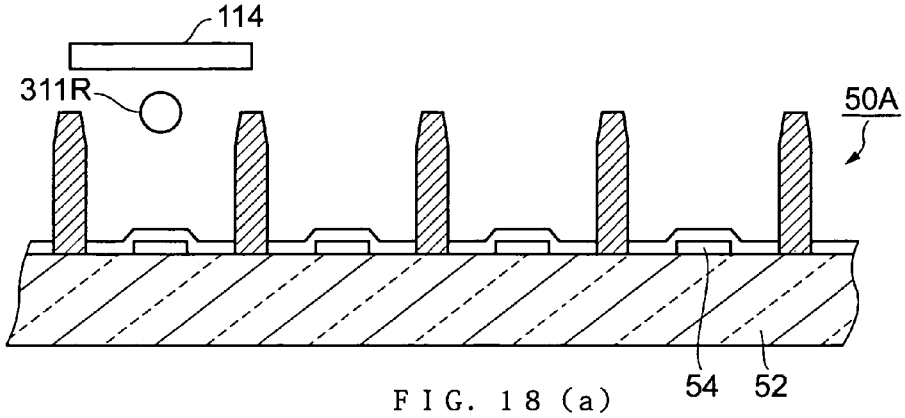
FIGS. 18(A) through 18(C) are views for explaining a manufacturing method of the plasma display device of embodiment 4.
Figure 18:
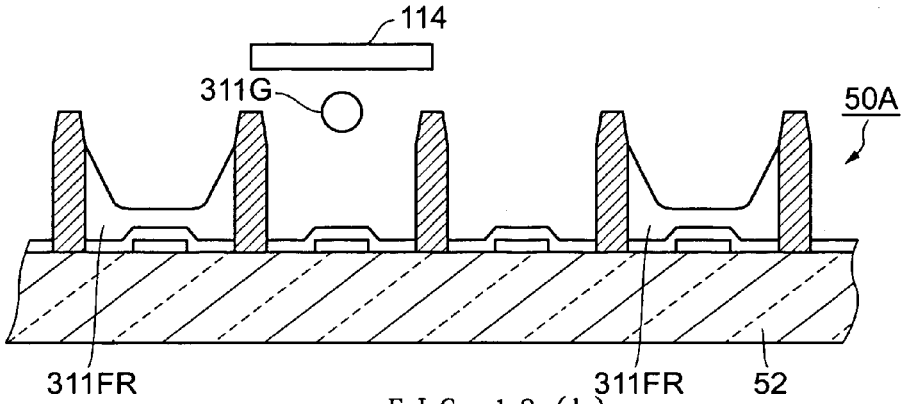
Figure 18:
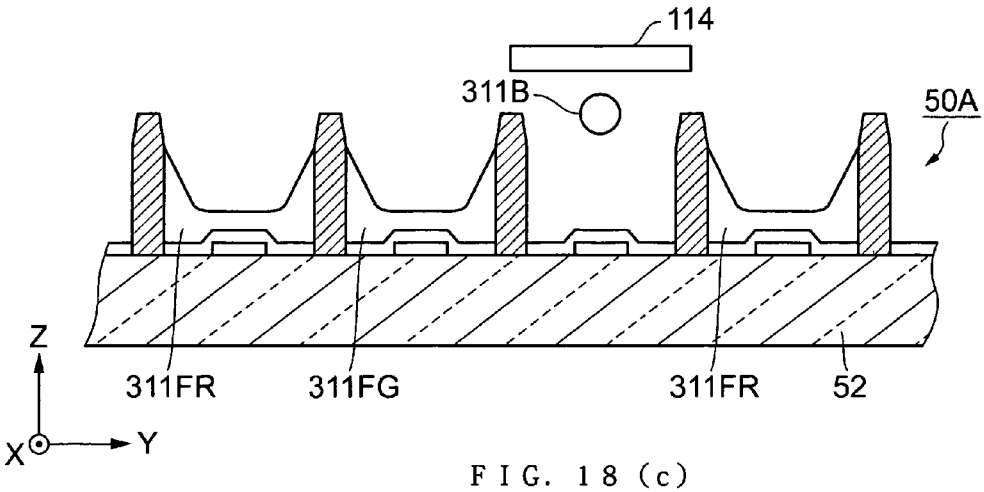

The base body 50A provided with the target sections 58R, 58G, and 58B is transferred to the stage 106 of the ejection device 300R by the carrying device 370. Then, as shown in FIG. 18(A), the ejection device 300R ejects the fluorescent material 311R from the head 114 in accordance with the signal from the control section 112 so as to form layers of the fluorescent material 311R on all of the target sections 58R.

More specifically, the ejection device 300R coats each of the plurality of target sections 58R with the fluorescent material 311R by executing the coating process described in embodiment 1.

When the layers of the fluorescent material 311R are formed on all of the target sections 58R of the base body 50A, the carrying device 370 positions the base body 50A inside the drying device 350R. Then, by sufficiently drying the fluorescent material 311R on the target sections 58R, the fluorescent layers 311FR are obtained on the target sections 58R.

Subsequently, the carrying device 370 positions the base body 50A on the stage 106 of the ejection device 300G. Then, as shown in FIG. 18(B), the ejection device 300G ejects the fluorescent material 311G from the head 114 in accordance with the signal from the control section 112 so as to form layers of the fluorescent material 311G on all of the target sections 58G. More specifically, the ejection device 300G coats each of the plurality of target sections 58G with the fluorescent material 311G by executing the coating process described in embodiment 1.

When the layers of the fluorescent material 311G are formed on all of the target sections 58G of the base body 50A, the carrying device 370 positions the base body 50A inside the drying device 350G. Then, by sufficiently drying the fluorescent material 311G on the target sections 58G, the fluorescent layers 311FG are obtained on the target sections 58G.

Subsequently, the carrying device 370 positions the base body 50A on the stage 106 of the ejection device 300B. Then, as shown in FIG. 18(C), the ejection device 300B ejects the fluorescent material 311B from the head 114 in accordance with the signal from the control section 112 so as to form layers of the fluorescent material 311B on all of the target sections 58B. More specifically, the ejection device 300B coats each of the plurality of target sections 58B with the fluorescent material 311B by executing the coating process described in embodiment 1.

When the layers of the fluorescent material 311B are formed on all of the target sections 58B of the base body 50A, the carrying device 370 positions the base body 50A inside the drying device 350B. Then, by sufficiently drying the fluorescent material 311B on the target sections 58B, the fluorescent layers 311FB (shown in FIG. 19) are obtained on the target sections 58B.

Through the above processes, the base body 50A is formed to be the back board 50B (shown in FIG. 19) of the plasma display device.

Figure 19:
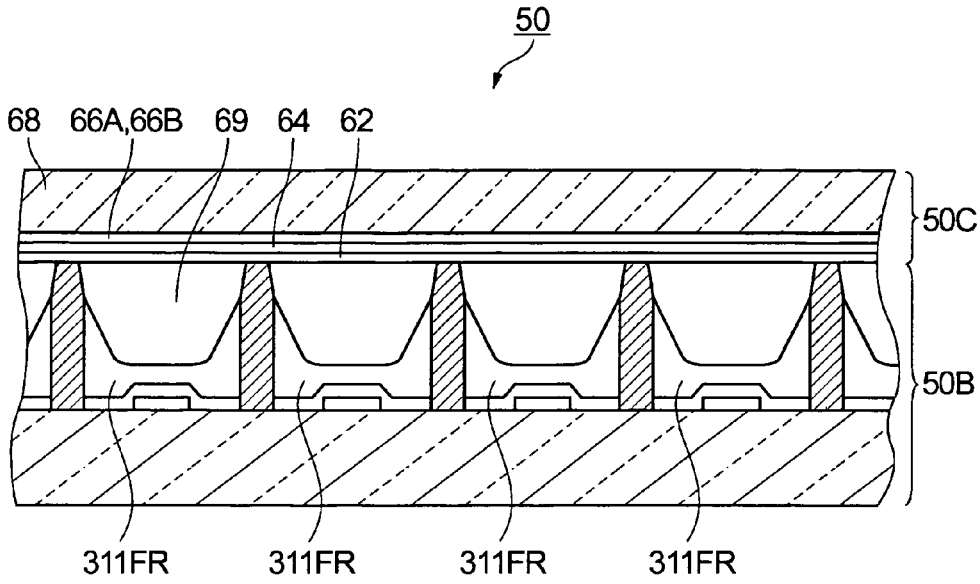
FIG. 19 is a schematic view showing a cross-section of the plasma display device manufactured by the manufacturing method of embodiment 4.

Subsequently, as shown in FIG. 19, the back board 50B is bonded with a front board 50C using a conventional process to obtain the plasma display device 50. The front board 50C comprises a glass substrate 68, display electrodes 66A and display scanning electrodes 66B both patterned on the glass substrate 68 parallel to each other, a dielectric glass layer 64 formed to cover the display electrodes 66A and the display scanning electrodes 66B, and a MgO protective layer 62 formed on the dielectric glass layer 64. The back board 50B and the front board 50C are aligned so that the address electrodes 54 of the back board 50B and the display electrodes 66A and the display scanning electrodes 66B of the front board 50C become perpendicular to one another. Cells (pixel areas) surrounded by the partition 60 are filled with a discharge gas 69 in predetermined pressure.

According to the present embodiment, the lives of the heads 114 of the ejection devices 300R, 300G, and 300B can be extended. This is because it is possible to make the ejection nozzles 118T (the ejection nozzles 118T belonging to the second nozzle groups GB) not corresponding to the target sections 58R, 58G, 58B share the burden of ejecting the fluorescent materials 311R, 311G, 311B.

Further, according to the present embodiment, the coating process can proceed while maintaining the stability of the manufacturing device 3. Since all of the ejection nozzles 118T of the heads 114 in the ejection devices 300R, 300G, 300B eject droplets D of the fluorescent materials in at least one of the first scan period and the second scan period, as a result, none of the ejection nozzles 118T is idle (do not perform any ejection) for a long interval. Therefore, the fluorescent material can be prevented from becoming hard in the nozzles during the coating process.

Embodiment 5

Hereinafter, an example will be described, in which the present invention is applied to the manufacturing device for an image display device equipped with an electron emitter element.

The base body 70A shown in FIGS. 20(A) and 20(B) is a substrate to be formed as an electron source substrate 70B of an image display device through processes by a manufacturing device 3 (shown in FIG. 21) described below. The substrate 70A includes a plurality of target sections 78 disposed in a matrix.

Specifically, the base body 70A is equipped with a base 72, a sodium diffusion preventing layer 74 disposed on the base 72, a plurality of element electrodes 76A, 76B disposed on the sodium diffusion preventing layer 74, a plurality of metal wires 79A positioned on the plurality of element electrodes 76A, and a plurality of metal wires 79B positioned on the plurality of element electrodes 76B. Each of the plurality of metal wires 79A has a shape extending in the Y axis direction. In contrast, each of the plurality of metal wires 79B has a shape extending in the X axis direction. Since an insulation layer 75 is formed between the metal wires 79A and the metal wires 79B, the metal wires 79A are electrically insulated from the metal wires 79B.

A portion including a pair of element electrodes 76A and 76B corresponds to one pixel area.

The pair of element electrodes 76A and 76B is facing to each other with a predetermined distance on the sodium diffusion preventing layer 74. The element electrode 76A corresponding to a certain pixel area is electrically connected to the corresponding metal wire 79A. Further, the element electrode 76B corresponding to the pixel area is electrically connected to the corresponding metal wire 79B. Note that, in the present specification, a combination of the base 72 and the sodium diffusion preventing layer 74 may be denoted as a support substrate.

In each of the pixel areas of the base body 70A, a part of the element electrode 76A, a part of the element electrode 76B, and the sodium diffusion preventing layer 74 exposed between the element electrodes 76A and 76B correspond to the target section 78. More specifically, the target section 78 is an area on which a conductive thin film 411F (shown in FIG. 24) is formed, and the conductive thin film 411F is formed so as to cover the part of the element electrode 76A, the part of the element electrode 76B, and the gap between the element electrodes 76A and 76B. As illustrated by a broken line in FIG. 20(B), a plane shape of the target sections 78 in the present embodiment are circles. As described above, the plane shapes of the target sections of the present invention could be circles determined with a X coordinate range and a Y coordinate range.

The base body 70A shown in FIG. 20(B) is positioned on a virtual plane parallel to both the X axis direction and the Y axis direction. A row direction and a column direction of the matrix formed of the plurality of target sections 78 are parallel to the X axis direction and the Y axis direction, respectively. In other words, the plurality of target sections 78 are aligned in the X axis direction and the Y axis direction. Note that the X axis direction and the Y axis direction are perpendicular to each other.

An interval LRY of the target sections 78 along the Y axis direction, namely the pitch thereof is about 190 μm. Further, the length of the target sections 78 along the X axis direction (the length of the X coordinate range) is about 100 μm, and the length thereof along the Y axis direction (the length of the Y coordinate range) is also about 100 μm. The intervals of the target sections 78 and the sizes of the target sections correspond to the intervals and the sizes of the pixels in a high resolution digital television of about 40 inches.

Figure 20:
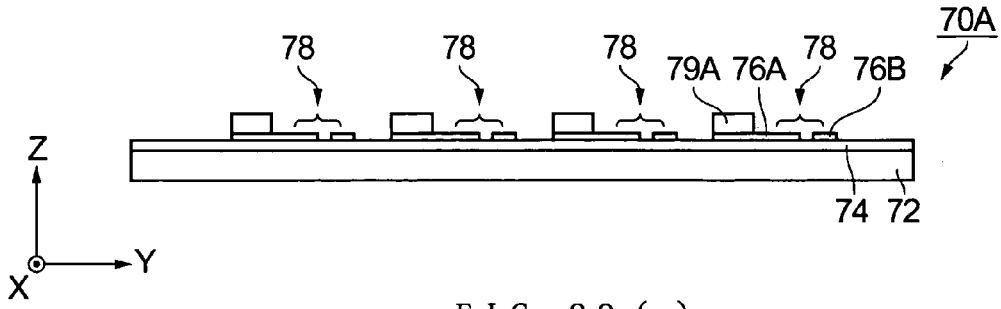
FIG. 20(A) is a schematic view showing a cross-section of a base body of an embodiment 5.
FIG. 20(B) is a schematic view showing an upper surface of the base body of embodiment 5.
Figure 20:
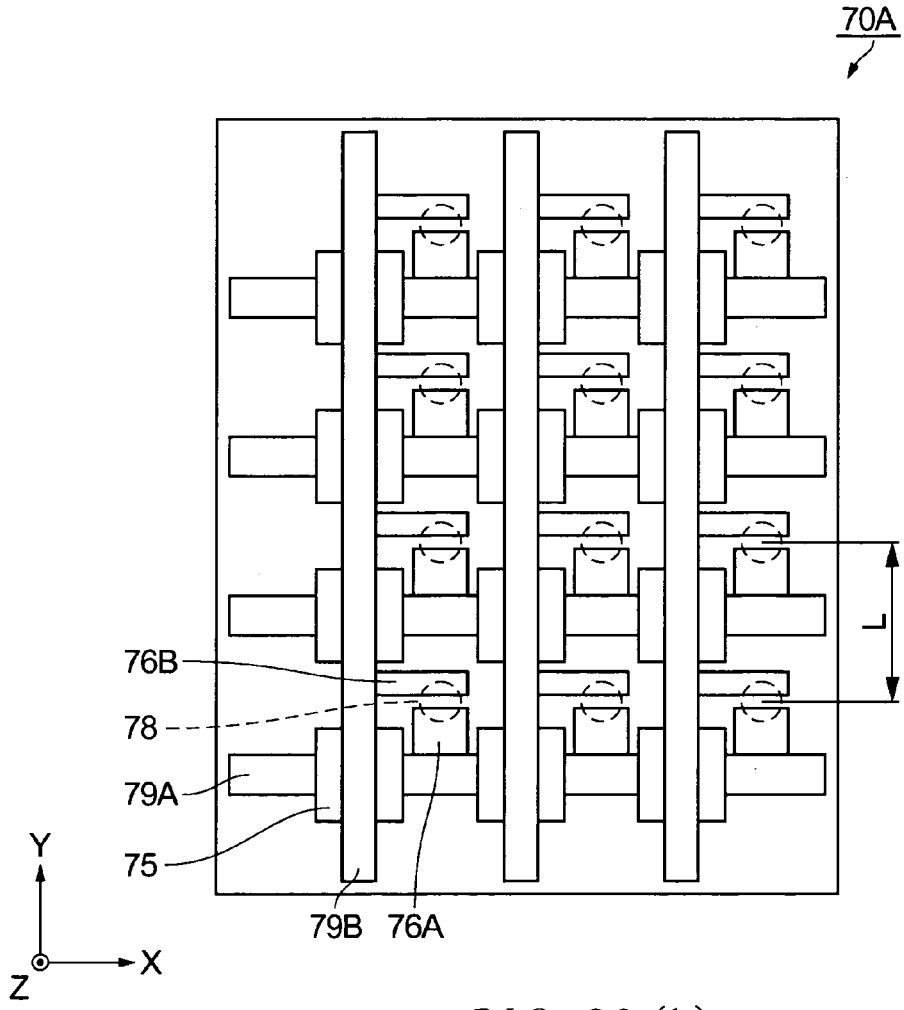
Figure 21:
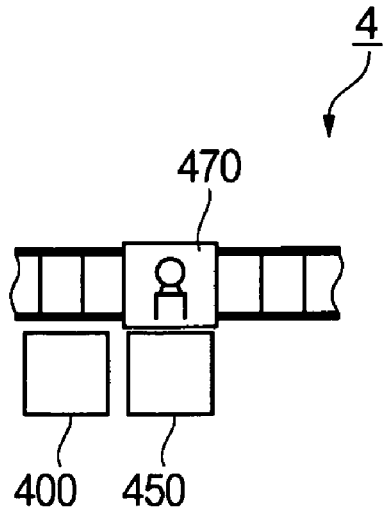
FIG. 21 is a schematic view showing a manufacturing device of a display device of embodiment 5.

The manufacturing device shown in FIG. 21 is a device for ejecting a conductive thin film material 411 to each of the target sections 78 of the base body 70A shown in FIGS. 20(A) and 20(B). Specifically, the manufacturing device 4 is equipped with a ejection device 400 for coating all of the target sections 78 with the conductive thin film material 411 and a drying device 450 for drying the conductive thin film material 411 on the target sections 78. Further, the manufacturing device 4 is equipped with a carrying device 470 for carrying the base body 70A to the ejection device 400 and then the drying device 450 in this order. The carrying device 470 is equipped with a fork section, a drive section for moving the fork section up and down, and a self-propelled section.

Figure 22:
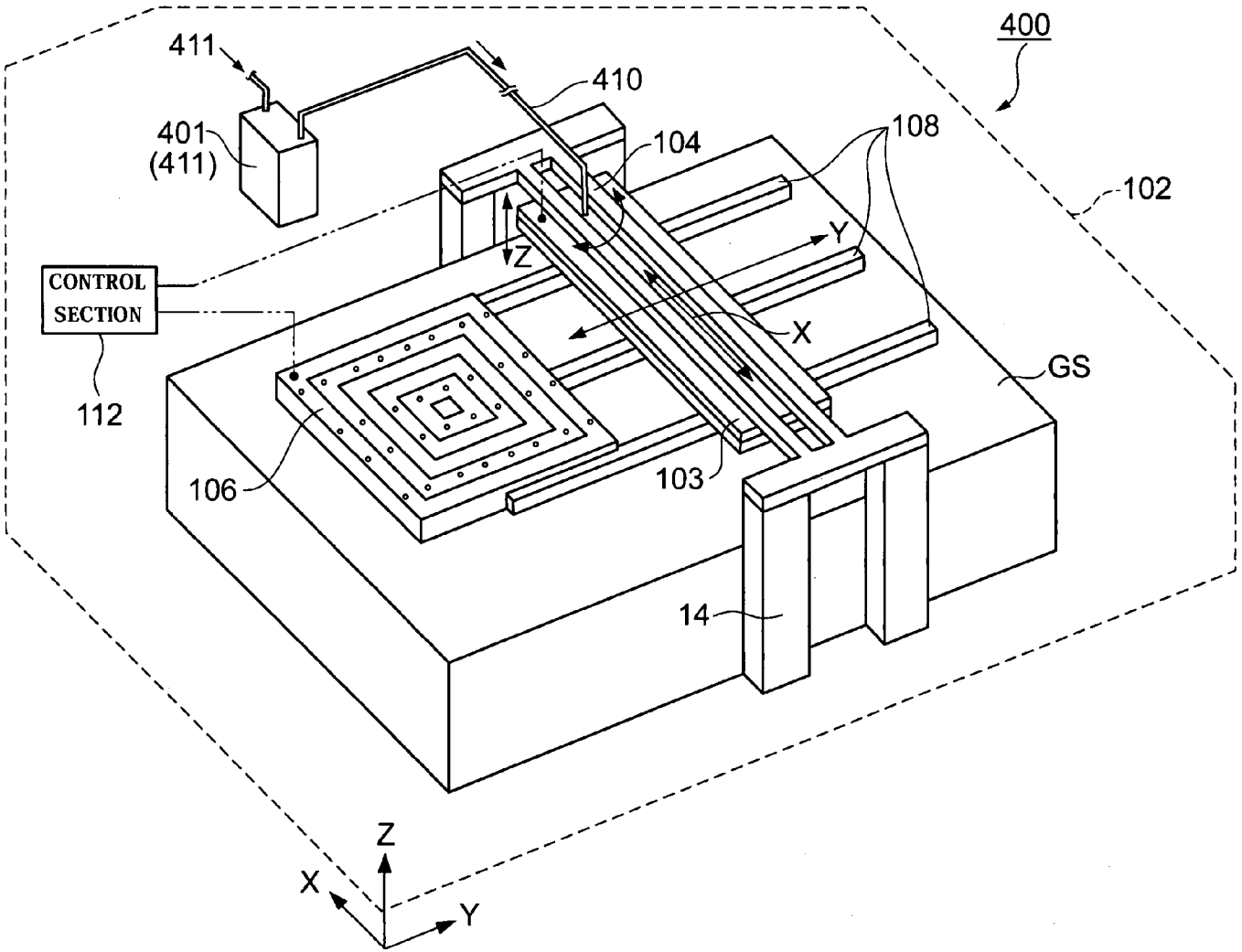
FIG. 22 is a schematic view showing an ejection device of embodiment 5.

The ejection device 400 shown in FIG. 22 is equipped with a tank 401 for containing the liquid conductive thin film material 411, a tube 410, and an ejection scanning section 102 to which the conductive thin film material 411 is supplied from the tank 401 via the tube 410. Since the description of the ejection scanning section 102 has been presented in embodiment 1, and accordingly, will be omitted here. In the present embodiment, the liquid conductive thin film material 411 is organic palladium solution. Note that the liquid conductive thin film material 411 in the present embodiment is one example of "a liquid material" of the present invention.

A method of manufacturing the image display device using the manufacturing device 4 will be described. First, the sodium diffusion preventing layer 74 composed mainly of $SiO_2$ is formed on the base 72 made of soda glass or the like. Specifically, the sodium diffusion preventing layer 74 is obtained by forming $SiO_2$ film of 1 μm thick on the base 72 using a sputter process. Subsequently, a titanium layer of 5 nm thick is formed on the sodium diffusion preventing layer 74 using a sputter process or a vacuum evaporation process. Then, a plurality of pairs of the element electrodes 76A and 76B with a predetermined distance is formed from the titanium layer using a photolithography process and an etching process.

Thereafter, by coating Ag paste on the sodium diffusion preventing layer 74 and a plurality of element electrodes 76A using a screen printing process followed by baking, a plurality of metal wires 79A extending along the Y axis direction is formed. Subsequently, the insulation film 75 is formed by coating a part of each of metal wires 79A with glass paste using a screen printing process followed by baking. Thereafter, by coating the Ag paste on the sodium diffusion preventing layer 74 and a plurality of element electrodes 76B using a screen printing process followed by baking, a plurality of metal wires 79B extending along the X axis direction is formed. Note that, when forming the metal wires 79B, the Ag paste is provided so that the metal wires 79B intersect with the metal wires 79A via the insulation film 75. Through the above processes, the base body 70A shown in FIG. 20 is obtained.

Then, lyophilicity is provided to the base body 70A using an oxygen plasma process under atmospheric pressure. According to this process, a part of the surface of the element electrode 76A, a part of the surface of the element electrode 76B, and the surface of the support substrate exposed between the element electrodes 76A and 76B are provided with lyophilicity. These surfaces form the target sections 78. Note that, in some cases, the surfaces with the required lyophilicity may be obtained depending on the materials thereof without executing the surface treatments described above. In such cases, the part of the surface of the element electrode 76A, the part of the surface of the element electrode 76B, and the surface of the sodium diffusion preventing layer 74 exposed between the element electrodes 76A and 76B form the target section 78 without executing the surface treatments described above.

Figure 23:
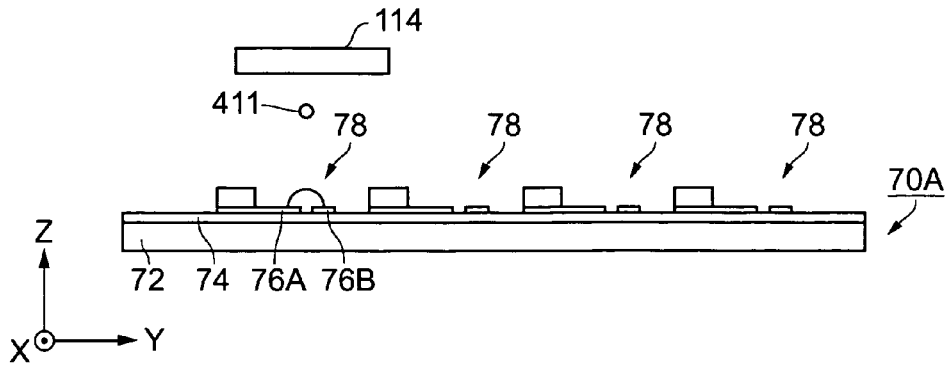
FIG. 23 is a view for explaining a manufacturing method of the display device of embodiment 5.

The base body 70A provided with the target sections 78 is carried to the stage 106 of the ejection device 400 by the carrying device 470. Then, as shown in FIG. 23, the ejection device 400 ejects the conductive thin film material 411 from the head 114 in accordance with the signal from the control section 112 so as to form the conductive thin film 411F on all of the target sections 78. More specifically, the ejection device 400 coats each of the plurality of target sections 78 with the conductive thin film material 411 by executing the coating process described in embodiment 1.

Further, in the present embodiment, the control section 112 provides a signal to the head 114 so that the diameters of the droplets of the conductive thin film material 411 landed on the target sections 78 are in the range of 60 μm to 80 μm. When the layers of the conductive thin film material 411 are formed on all of the target sections 78 of the base body 70A, the carrying device 470 positions the base body 70A inside the drying device 450. By sufficiently drying the conductive thin film material 411 on the target sections 78, the conductive thin films 411F mainly composed of palladium oxide are obtained on the target sections 78. As described above, in each of the pixel areas, the conductive thin film 411F is formed so as to cover the part of the element electrode 76A, the part of the element electrode 76B, and the sodium diffusion preventing layer 74 exposed between the element electrodes 76A and 76B.

According to the present embodiment, the life of the head 114 of the ejection device 400 can be extended. This is because it is possible to make the ejection nozzles 118T (the ejection nozzles 118T belonging to the second nozzle groups GB) not corresponding to the target section 78 share the burden of ejecting the conductive thin film material 411.

Further, according to the present embodiment, the coating process can proceed while maintaining the stability of the manufacturing device 4. Since all of the ejection nozzles 118T of the heads 114 in the ejection devices 400 eject droplets D of the conductive thin film materials in at least one of the first scan period and the second scan period, as a result, none of the ejection nozzles 118T is idle (do not perform any ejection) for a long interval. Therefore, the conductive thin film material can be prevented from becoming hard in the nozzles 118T during the coating process.

Subsequently, by applying a predetermined pulse voltage between the element electrode 76A and the element electrode 76B, an electron emission section 411D is formed in a part of the conductive thin film 411F. Note that the application of the voltage between the element electrode 76A and the element electrode 76B is preferably executed in an organic atmosphere and in a vacuum respectively. According to the above, the efficiency of electron emission from the electron emission section 411D can be enhanced. The element electrode 76A, the element electrode 76B corresponding thereto, and the conductive thin film 411F form the electron emitter element. Further, each of the electron emitter elements corresponds to the respective pixel areas.

Figure 24:
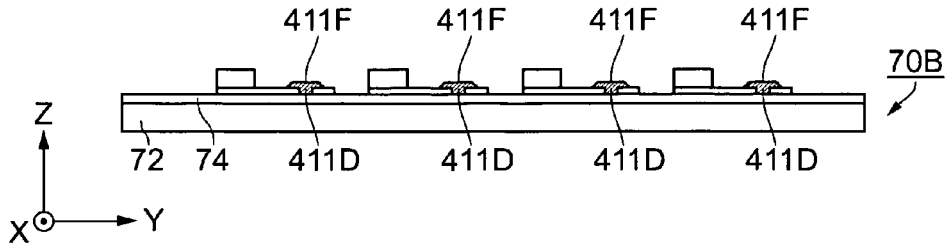
FIG. 24 is a view for explaining a manufacturing method of the display device of embodiment 5.

Through the above processes, as shown in FIG. 24, the base body 70A becomes the electron source substrate 70B.

Figure 25:
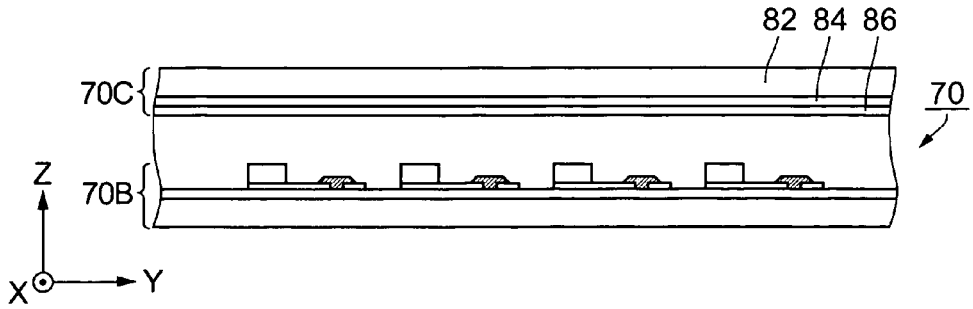
FIG. 25 is a schematic view showing a cross-section of the display device manufactured by the manufacturing method of embodiment 5.

Subsequently, as shown in FIG. 25, the electron source substrate 70B is bonded with a front board 70C using a conventional process to obtain the image display device 70. The front board 70C comprises a glass substrate 82, a plurality of fluorescent section 84 disposed on the glass substrate 82 in a matrix, and a metal plate 86 covering the plurality of fluorescent section 84. The metal plate 86 functions as an electrode for accelerating an electron beam from the electron emission section 411D. The electron source substrate 70B and the front board 70C are aligned so that each of the electron emitter elements faces the respective one of the plurality of fluorescent section 84. Further, the gap between the electron source substrate 70B and the front board 70C is kept a vacuum.

Note that the image display device 70 equipped with the above electron emitter element may sometimes be called SED (Surface-Conduction Electron-Emitter Display) or FED (Field Emission Display). Further, in the present specification, a liquid crystal display device, an electroluminescence display device, a plasma display device, an image display device utilizing the electron emitter element or the like may be denoted as "electro-optic device." Here, "electro-optic device" in the present specification is not limited to devices utilizing changes in optical characteristics (so-called electro-optical effects) such as changes in birefringence, changes in optical rotation, or changes in light scattering property, but means general devices for emitting, transferring, or reflecting light in accordance with application of a signal voltage.

What is claimed is:

1. An ejection device for coating a target section of a base body with a liquid material, comprising:

a stage for mounting the base body;

a head having a plurality of ejection nozzles, each of the plurality of ejection nozzles belonging to either one of a first nozzle train or a second nozzle train, the first nozzle train extending in an X axis direction and the second nozzle train extending in the X axis direction and substantially parallel to and spaced apart from the first nozzle train along a Y axis direction that is substantially perpendicular to the X axis direction;

a first nozzle group including three nozzles from the first nozzle train and two nozzles from the second nozzle train;

a second nozzle group including one nozzle from the second nozzle train, the second nozzle group disposed adjacent to the first nozzle group in the X axis direction; and a scan section for moving at least one of the stage and the head relative to the other along the Y axis perpendicular to the X axis during first and second scan periods, the scan section moving at least one of the stage and the head relative to the other in a first direction along the Y axis during the first scan period and moving at least one of the stage and the head relative to the other in a second direction opposite the first direction along the Y axis during the second scan period;

wherein each of the ejection nozzles forming the first nozzle group is positioned in an ejectable range of the target section along the X axis direction during the first scan period, each of the ejection nozzles forming the second nozzle group is positioned out of the ejectable range during the first scan period, the scan section moves at least one of the stage and the head relative to the other in the X axis direction in a period between the first scan period and the second scan period so as to position each of the ejection nozzles forming the second nozzle group in the ejectable range, and the head selectively ejects the liquid material to the target section from the ejection nozzles forming the first nozzle group in the first scan period, and selectively ejects the liquid material to the target section from the ejection nozzles forming the second nozzle group in the second scan period.

2. A method of coating with a liquid material by using an ejection device including a stage for mounting a base body, the method comprising:

positioning a first nozzle train having a plurality of ejection nozzles on a head and extending along an X axis direction;

positioning a second nozzle train having a plurality of ejection nozzles on the head and extending in the X axis direction, the second nozzle train being parallel to and spaced apart from the first nozzle train along a Y axis direction that is substantially perpendicular to the X axis direction;

forming a first nozzle group that includes three nozzles from the first nozzle train and two nozzles from the second nozzle train;

forming a second nozzle group that includes one nozzle from the second nozzle train, the second nozzle group disposed adjacent to the first nozzle group in the X axis direction;

moving at least one of the stage and the head relative to the other in a first direction along the Y axis perpendicular to the X axis direction in a first scan period while positioning each of the ejection nozzles forming the first nozzle group in an ejectable range of a target section of the base body along the X axis direction and each of the ejection nozzles forming the second nozzle group out of the ejectable range;

moving at least one of the stage and the head relative to the other in a second direction opposite the first direction and along the Y axis perpendicular to the X axis direction in a second scan period while positioning each of the ejection nozzles forming the second nozzle group in the ejectable range;

selectively ejecting the liquid material from each of the nozzles forming the first nozzle group to the target section in the first scan period; and selectively ejecting the liquid material from each of the nozzles forming the second nozzle group to the target section in the second scan period.

3. A method of manufacturing a color filter substrate using an ejection device including a stage for mounting a base body, the method comprising:

positioning a first nozzle train having a plurality of ejection nozzles on a head and extending along an X axis direction;

positioning a second nozzle train having a plurality of ejection nozzles on the head and extending in the X axis direction, the second nozzle train being parallel to and spaced apart from the first nozzle train along a Y axis direction that is substantially perpendicular to the X axis direction;

forming a first nozzle group that includes three nozzles from the first nozzle train and two nozzles from the second nozzle train;

forming a second nozzle group that includes one nozzle from the second nozzle train, the second nozzle group disposed adjacent to the first nozzle group in the X axis direction;

moving at least one of the stage and the head relative to the other in a first direction along the Y axis perpendicular to the X axis direction in a first scan period while positioning each of the ejection nozzles forming the first nozzle group in an ejectable range of a target section of the base body along the X axis direction and each of the ejection nozzles forming the second nozzle group out of the ejectable range;

moving at least one of the stage and the head relative to the other in a second direction opposite the first direction and along the Y axis perpendicular to the X axis direction in a second scan period while positioning each of the ejection nozzles forming the second nozzle group in the ejectable range;

selectively ejecting a liquid color filter material from each of the nozzles forming the first nozzle group to the target section in the first scan period; and selectively ejecting the liquid color filter material from each of the nozzles forming the second nozzle group to the target section in the second scan period.

4. A method of manufacturing an electroluminescence display device by using an ejection device including a stage for mounting a base body, the method comprising:

positioning a first nozzle train having a plurality of ejection nozzles on a head and extending along an X axis direction;

positioning a second nozzle train having a plurality of ejection nozzles on the head and extending in the X axis direction, the second nozzle train being parallel to and spaced apart from the first nozzle train along a Y axis direction that is substantially perpendicular to the X axis direction;

forming a first nozzle group that includes three nozzles from the first nozzle train and two nozzles from the second nozzle train;

forming a second nozzle group that includes one nozzle from the second nozzle train, the second nozzle group disposed adjacent to the first nozzle group in the X axis direction;

moving at least one of the stage and the head relative to the other in a first direction along the Y axis perpendicular to the X axis direction in a first scan period while positioning each of the ejection nozzles forming the first nozzle group in an ejectable range of a target section of the base body along the X axis direction and each of the ejection nozzles forming the second nozzle group out of the ejectable range;

moving at least one of the stage and the head relative to the other in a second direction opposite the first direction and along the Y axis perpendicular to the X axis direction in a second scan period while positioning each of the ejection nozzles forming the second nozzle group in the ejectable range;

selectively ejecting a liquid light emitting material from each of the nozzles forming the first nozzle group to the target section in the first scan period; and selectively ejecting the liquid light emitting material from each of the nozzles forming the second nozzle group to the target section in the second scan period.

5. A method of manufacturing a plasma display device by using an ejection device including a stage for mounting a base body, the method comprising:

positioning a first nozzle train having a plurality of ejection nozzles on a head and extending along an X axis direction;

positioning a second nozzle train having a plurality of ejection nozzles on the head and extending in the X axis direction, the second nozzle train being parallel to and spaced apart from the first nozzle train alone a Y axis direction that is substantially perpendicular to the X axis direction;

forming a first nozzle group that includes three nozzles from the first nozzle train and two nozzles from the second nozzle train;

forming a second nozzle group that includes one nozzle from the second nozzle train, the second nozzle group disposed adjacent to the first nozzle group in the X axis direction;

moving at least one of the stage and the head relative to the other in a first direction along the Y axis perpendicular to the X axis direction in a first scan period while positioning each of the ejection nozzles forming the first nozzle group in an ejectable range of a target section of the base body along the X axis direction and each of the ejection nozzles forming the second nozzle group out of the ejectable range;

moving at least one of the stage and the head relative to the other in a second direction opposite the first direction and along the Y axis perpendicular to the X axis direction in a second scan period while positioning each of the ejection nozzles forming the second nozzle group in the ejectable range;

selectively ejecting a liquid fluorescent material from each of the nozzles forming the first nozzle group to the target section in the first scan period; and selectively ejecting the liquid fluorescent material from each of the nozzles forming the second nozzle group to the target section in the second scan period.

* * * * *